US006853732B2

(12) United States Patent
Scofield

(10) Patent No.: US 6,853,732 B2
(45) Date of Patent: Feb. 8, 2005

(54) CENTER CHANNEL ENHANCEMENT OF VIRTUAL SOUND IMAGES

(75) Inventor: William Clayton Scofield, Vestavia Hills, AL (US)

(73) Assignee: Sonics Associates, Inc., Birmingham, AL (US)

( * ) Notice: Subject to any disclaimer, the term of this patent is extended or adjusted under 35 U.S.C. 154(b) by 214 days.

(21) Appl. No.: 09/872,671

(22) Filed: Jun. 1, 2001

(65) Prior Publication Data

US 2002/0006206 A1 Jan. 17, 2002

Related U.S. Application Data

(63) Continuation-in-part of application No. 09/392,208, filed on Sep. 8, 1999, which is a continuation of application No. 09/200,396, filed on Nov. 24, 1998, now Pat. No. 6,144,747, which is a continuation of application No. 08/832,377, filed on Apr. 2, 1997, now Pat. No. 5,841,879, which is a continuation of application No. 08/753,259, filed on Nov. 21, 1996, now Pat. No. 5,661,812, which is a continuation of application No. 08/208,622, filed on Mar. 8, 1994, now abandoned.

(51) Int. Cl.[7] ..... H04R 5/00; H04R 5/02

(52) U.S. Cl. ..... 381/27; 381/309; 381/310

(58) Field of Search ..... 381/309, 310, 381/1, 17, 18, 26, 74, 304, 305, 300

(56) References Cited

U.S. PATENT DOCUMENTS

| | | | | |
|---|---|---|---|---|
| 4,841,573 A | | 6/1989 | Fujita | 381/27 |
| 4,933,921 A | * | 6/1990 | Saunders | 369/5 |
| 5,197,100 A | * | 3/1993 | Shiraki | 381/27 |
| 5,297,209 A | | 3/1994 | Kowaki | 381/10 |
| 5,333,200 A | | 7/1994 | Cooper et al. | 381/1 |
| 5,426,702 A | | 6/1995 | Aarts | 381/27 |
| 5,438,623 A | | 8/1995 | Begault | 381/17 |
| 5,459,790 A | | 10/1995 | Scofield et al. | 381/25 |
| 5,590,204 A | | 12/1996 | Lee | 381/24 |
| 5,610,986 A | | 3/1997 | Miles | 381/27 |
| 5,854,847 A | | 12/1998 | Yoshida et al. | 381/302 |
| 6,122,382 A | * | 9/2000 | Iida et al. | 381/18 |

OTHER PUBLICATIONS

*A Rational Technique for Synthesizing Pseudo–Stereo From Monophonic Sources*; Orban; Journal of the Audio Engineering Society, Apr. 1970, vol. 18, No. 2, pp. 157–164.

*Further Thoughts on "A Rational Technique for Synthesizing Pseudo Stereo From Monophonic Sources*; " Orban; Journal of the Audio Engineering Society, Apr. 1970, vol. 18, No. 4, pp. 443–444.

*The Stereo Synthesizer and Stereo Matrix: New Techniques for Generating Stereo Space*; Orban; Audio Engineering Society, 38th Convention, May 1970.

* cited by examiner

*Primary Examiner*—Xu Mei

(57) ABSTRACT

The present invention disclosed and claimed herein, in one aspect thereof, comprises a method for enhancing the front sound image during reproduction in a listening space of a stereo sound program, comprising the steps of receiving left and right channels of the stereo sound program; generating a virtual center channel signal from the left and right channels of the stereo sound program; and driving a center channel speaker with the virtual center channel signal, the center channel speaker disposed at a central location in a front portion of the listening space.

31 Claims, 13 Drawing Sheets

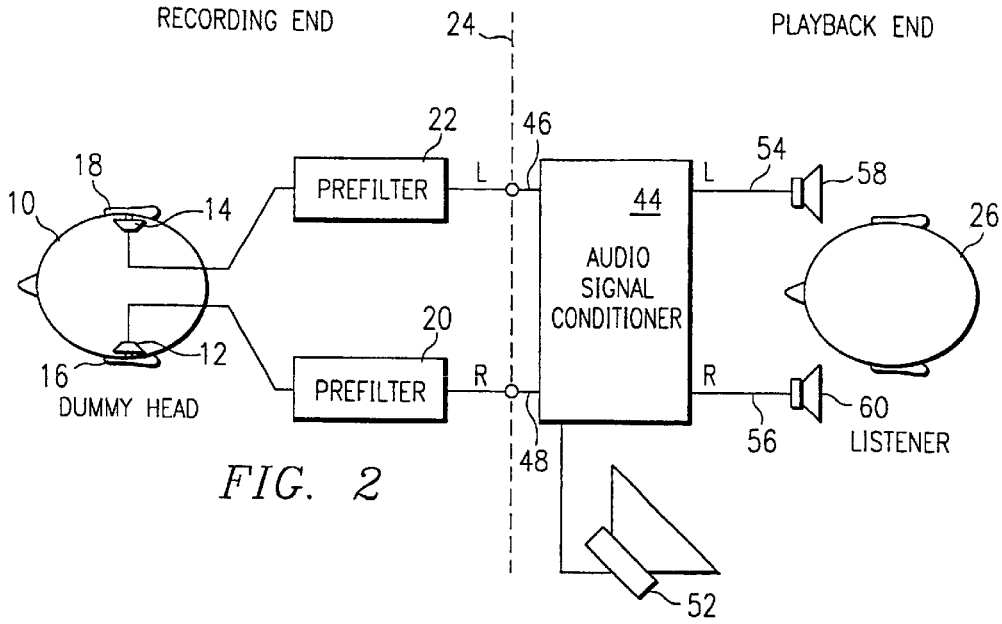
FIG. 2
FIG. 3
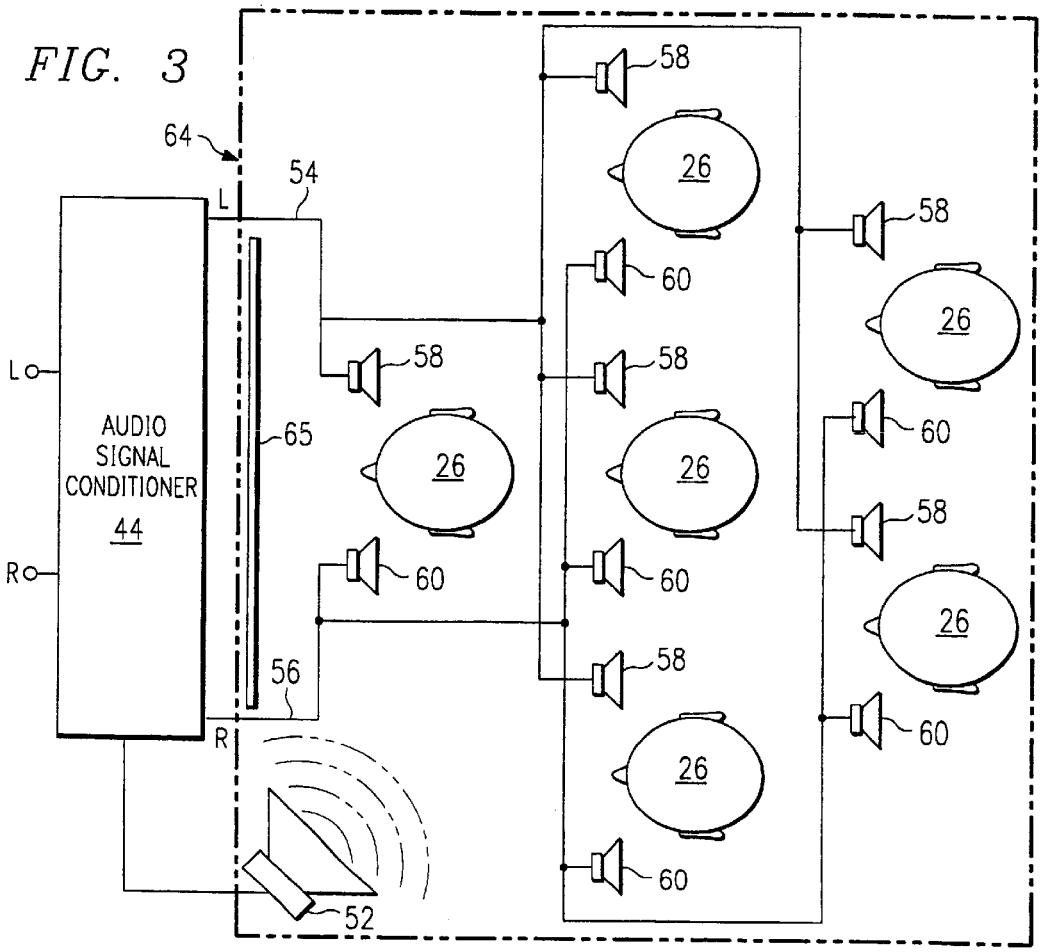

CENTER CHANNEL ENHANCEMENT OF VIRTUAL SOUND IMAGES

CROSS-REFERENCE TO RELATED APPLICATIONS

The present application is a Continuation-in-Part of pending U.S. patent application Ser. No. 09/392,208 filed Sep. 8, 1999 entitled "METHOD AND APPARATUS FOR VIRTUAL POSITIONING OF SOUND SOURCES,"; which is a Continuation Application of U.S. patent application Ser. No. 09/200,396 filed Nov. 24, 1998 now U.S. Pat. No. 6,144,747 entitled "VIRTUALLY POSITIONED HEAD MOUNTED SURROUND SOUND SYSTEM,"; which is a continuation of Ser. No. 08/832,377 field Apr. 2, 1997 now U.S. Pat. No. 5,841,879 issued Nov. 24, 1998 entitled entitled "VIRTUALLY POSITIONED HEAD MOUNTED SURROUND SOUND SYSTEM,"; which is a continuation of Ser. No. 08/753,259 filed Nov. 21,1996 now U.S. Pat. No. 5,661,812 issued Aug. 26, 1997 entitled "HEAD MOUNTED SURROUND SOUND SYSTEM,"; which is a continuation of U.S. patent application Ser. No. 08/208,622 filed Mar. 8, 1994, abandoned, entitled "HEAD MOUNTED SURROUND SOUND SYSTEM,".

TECHNICAL FIELD OF THE INVENTION

The present invention pertains in general to a sound reproduction system and, more particularly, to enhancements to a sound system providing virtually positioned, three-dimensional sound images.

BACKGROUND OF THE INVENTION

In a theater for showing a video program, movie or film to a plurality of listeners a conventional surround sound system includes front left and right "stereo" speakers and rear left and right speakers. Often, a fifth speaker is centered in the front between the left and right speakers, primarily for reproducing the voice portions of the sound track. This center speaker may also be used to "fill in the middle" of the stereo sound image that is apparent in some program material or to supplement the low frequency portion of the sound track. Further, in situations where the listeners are provided headsets which position localized left and right speakers in the plane of the listener's zygomatic arch and near or proximate the listener's ears (but not in contact with or covering the listener's ears), sound radiated by a center speaker located near the video screen can help mitigate the "in the head" or "hole in the middle" sensations that listeners experience while listening to the sound track through headset devices. It has been learned through experiment, however, that the contribution of the center front speaker to the overall sound image during listening through the localized speaker type of headset may be markedly enhanced when the signals fed to the center front speaker are processed in blending networks such as described in the present disclosure.

SUMMARY OF THE INVENTION

The present invention disclosed and claimed herein comprises a method for enhancing the front sound image during reproduction in a listening space of a stereo sound program, comprising the steps of receiving left and right channels of the stereo sound program; generating a virtual center channel signal from the left and right channels of the stereo sound program; and driving a center channel speaker with the virtual center channel signal, the center channel speaker disposed at a central location in a front portion of the listening space.

BRIEF DESCRIPTION OF THE DRAWINGS

For a more complete understanding of the present invention and the advantages thereof, reference is now made to the following description taken in conjunction with the accompanying Drawings in which:

FIG. 2 illustrates a block diagram of the present invention;

FIG. 3 illustrates a diagram of the present invention utilized with a plurality of listeners in an auditorium;

DETAILED DESCRIPTION OF THE INVENTION

Figure 1A:
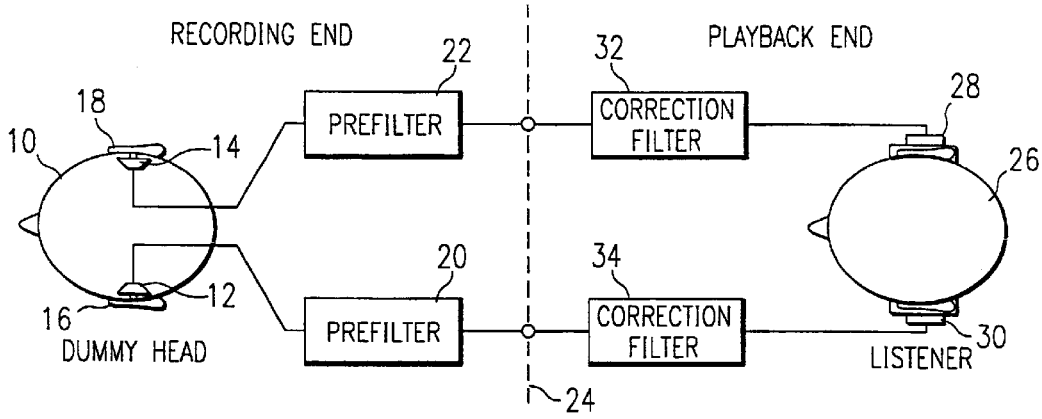
FIG. 1a (PRIOR ART)
FIGS. 1*a* and 1*b* illustrate diagrams of the prior art multi-dimensional sound systems.

Referring now to FIG. 1*a*, there is illustrated a schematic diagram of a prior art system for recording and playing back binaural sound. The prior art system is divided into a recording end and a playback end. In the recording end, a dummy head 10 is provided which has microphones 12 and 14 disposed in place of the ear canals. Two artificial pinnas 16 and 18, respectively, are provided for approximating the response of the human ear. The output of each of the microphones 12 and 14 is fed through pre-filters 20 and 22, respectively, to a plane 24, representing the barrier between the recording end and the playback end. The transfer function between the artificial ears 16 and 18 and the barrier 24 represents the first half of an equalizing system with the pre-filters 20 and 22 providing part of this equalization.

The playback end includes a listener 26 which has headphones comprised of a left earpiece 28 and a right earpiece 30. A correction filter 32 is provided between the barrier 24 and the earphone 28 and a correction filter 34 is provided between the barrier 24 and the earphone 30. The correction filter 34 is connected to the output of the pre-filter 20 and the correction filter 32 is connected to the output of the pre-filter 22. The transfer function between the barrier 24 and the earphone 30 represents the playback end transfer function. The product of the recording end transfer function and the playback end transfer function represents the overall transfer function of the system. The pre-filters 20 and 22 and the correction filters 32 and 34 provide an equalization which, when taken in conjunction with the response of the dummy head, should result in a true reproduction of the sound. It should be appreciated that the earphones 28 and 30 alter the natural response of the pinna for the listener 26, and therefore, the equalization process must account for this.

Figure 1B:
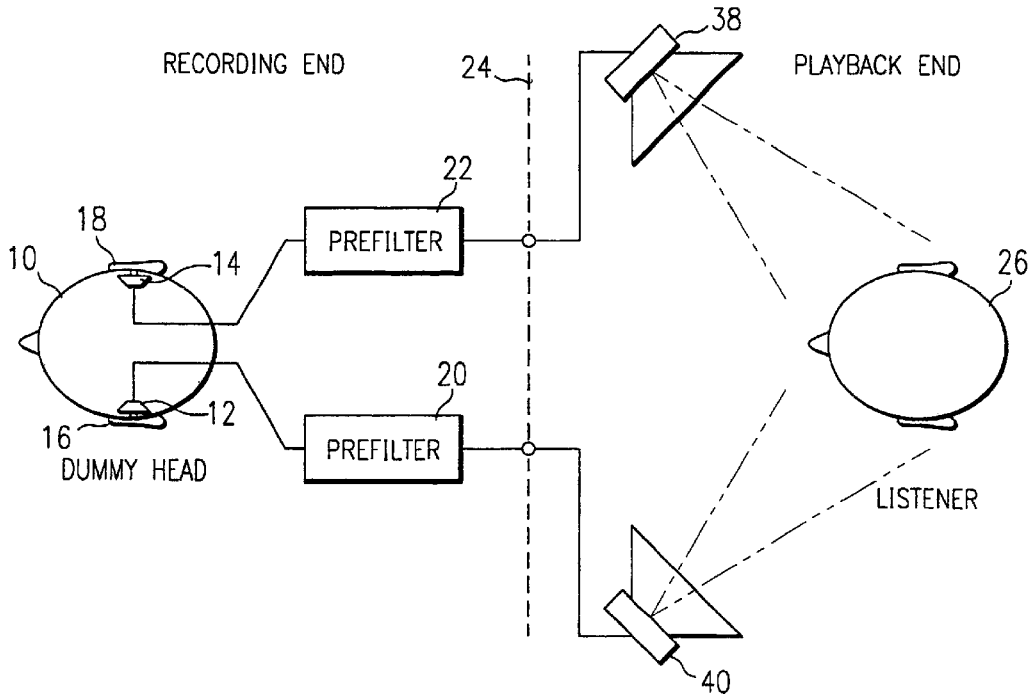
FIG. 1b (PRIOR ART)

Referring now to FIG. 1*b*, there is illustrated a diagrammatical representation of a prior art system, which is similar to the system of FIG. 1*a* with the exception that speakers 38 and 40 replace the headphones 28 and 30 and associated correction filters 32 and 34. However, when headphones are replaced by speakers, one problem that exists is cross-talk between the two speakers, since the speakers are typically disposed a large distance from the ears of the listener. Therefore, sound emanating from speaker 40 can impinge upon both ears of the listener 26, as can sound emitted by speaker 38. Further, the room acoustics would also affect the sound reproduction in that reflections occur from the walls of the room.

Headphones, as compared to speakers, are usually equalized to a free field in that their transfer function ideally corresponds to that of a typical external ear when sound is presented in a free sound field directly from the front and from a considerable distance. This does not lend itself to reproduction from a loudspeaker. In general, loudspeakers will require some type of equalization to be performed at the recording end, but this will still result in distortions of tone and color. It can be seen that although the loudspeakers can be somewhat equalized with respect to a given position, the cross-talk of the speakers must be accounted for. However, when dealing with a large auditorium, this must occur for all the listeners at any given position, which is difficult at best.

Referring now to FIG. 2, there is illustrated a diagram of the head mounted system utilized in conjunction with the present invention. The binaural recording is input to a signal conditioner 44 as a left and a right signal on lines 46 and 48, respectively. The signal conditioner 44, as will be described hereinbelow, is operable to combine the left and the right signals for frequencies below 250 Hz and input them to low frequency speaker 52, there being no left or right distinctions made in the speaker 52. In addition, the left and right signals of lines 46 and 48 are output as separate signals on left and right lines 54 and 56 to localized speakers 58 and 60 which are disposed proximate to the ears of the listener 26. The localized speakers 58 and 60 are disposed such that they do not disturb the natural conch resonance of the ears of the listener 26, and they are disposed such that the sound emitted from either of the speakers 58 and 60 is significantly attenuated with respect to the hearing on the opposite side of the head. This is facilitated by disposing the localized speakers 58 and 60 proximate to the head such that the natural separation provided by the head will be maintained.

Only signals above 250 Hz are transmitted to the localized speakers 58 and 60. As will be described hereinbelow, a delay is provided to the sound emitted from localized speakers 58 and 60 as compared to that emitted from speaker 52, such that the sound emitted from speaker 52 will arrive at the location of the listener 26 at the approximate time that the sound is emitted from localized speakers 58 and 60, within at worst plus and minus 25 ms. This accounts for the sound delay through the room and the distance of the listener 26 from the speaker 52. It has been noted that the important localization cues are not contained in the low frequency portion of the signal. Therefore, this low frequency portion of the audio spectrum is split out and routed to the listeners through the speaker 52. In this manner, the amount of sound energy that can be output at the low frequencies is increased, since the small size of the transducers that will be utilized for the localized speakers 58 and 60 cannot reproduce low frequency sounds with any acceptable fidelity.

Referring now to FIG. 3, there is illustrated a diagram of the system utilized with a plurality of listeners 26. Each of the listeners 26 has associated therewith a set of localized speakers 58 and 60. The listeners 26 are disposed in a room 64 with the speaker 52 disposed in a predetermined and fixed location. Since it is desirable that sound from the speaker 52 arrive at all of the listeners 26 generally at the same time, the speaker 52 would be located some distance from the listeners 26, it being understood that FIG. 3 is not drawn to scale. A viewing screen 65 is disposed in front of the listeners 26 to provide visual cues.

The localized speakers 58 and 60 are supported on the heads of listeners 26 such that they are maintained at a predetermined and substantially fixed position relative to the head. Therefore, if the head were to move when, for example, viewing a movie, there would be no phase change in the sound arriving at either of the ears of the listener 26. Therefore, a support member is provided which is affixed to the head of the listener 26 to support the localized speakers 58 and 60. In the preferred embodiment, groups consisting of six listeners are connected to common wires 54 and 56, such that the localized speakers 58 and 60 associated with each of the listeners 26 in a common group are connected to these wires, respectively. The sound level is adjusted such that each listener 26 will hear the sound at the appropriate phase from the associated one of the localized speakers 58 and 60. However, it has been determined experimentally that a listener 26 disposed in an adjacent seat with sound being emitted from his associated localized speakers 58 and 60 will not interfere with the sound received by the one listener 26. This is due to the fact that the sound levels are relatively low. If the localized speakers 58 and 60 are removed, then a listener 26 can hear sound emitted from localized speakers 58 and 60 among the listeners' seats adjacent thereto. The human ear "locks" onto the sound emitted from its associated localized speakers 58 and 60 and tends to ignore the sound from speakers disposed adjacent thereto. This is the result of many factors, including the Law of the First Wavefront.

The combination of the localized speakers 58 and 60 and visual cues on the screen 65 provide an additional aspect to the listener's ability to localize sound. In general, the listener cannot localize sound very well when it is directly in front or in back of the listener's head. Some type of head movement or visual cue would normally facilitate localization of the sound. Since the localized speakers 58 and 60 are fixed to the listener's head, visual cues on the screen 65 provide the listeners 26 with additional information to assist in localizing the sound.

Figure 4:
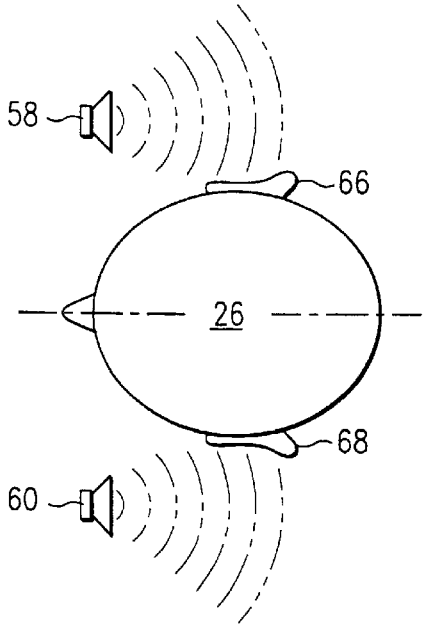
FIG. 4 illustrates a detail of the orientation of the localized speakers.

Referring now to FIG. 4, there is illustrated a detail of the orientation of the localized speakers 58 and 60 relative to the listener 26. The localized speaker 58 is disposed proximate to the right ear of the listener and its associated pinna 66. Similarly, the localized speaker 60 is disposed proximate to the left ear of the listener 26 and the associated pinna 68. In the preferred embodiment, the localized speakers 58 and 60 are disposed forward of the pinnas 66 and 68, respectively, and proximate to the head of the listener 26. It has been determined experimentally that the optimum sound reproduction occurs when the speaker is directed rearward and disposed proximate to the zygomatic arch of the listener 26. If the associated localized speaker 58 or 60 is moved outward, directly to the side of the ear, the actual physical size of the speaker tends to disturb the conch resonance. However, if the speaker were reduced to an extremely small size, this would be acceptable.

It is important that the speaker not be moved too far from the listener, as cross-talk would occur. Of course, any type of separation in the front, the rear or on top of the head would improve this. The torso, of course, provides separation beneath the head, but it would be necessary to improve the separation in the space forward, rearward and upward of the head if the localized speakers 58 and 60 were moved away from the head. However, in the preferred embodiment, the localized speakers 58 and 60 are designed to be utilized in an auditorium with multiple users all receiving the same or similar signals. Therefore, they are disposed as close to the ear as possible without disturbing the conch resonance and to minimize the sound level necessary for output from the localized speakers 58 and 60.

Figure 5:
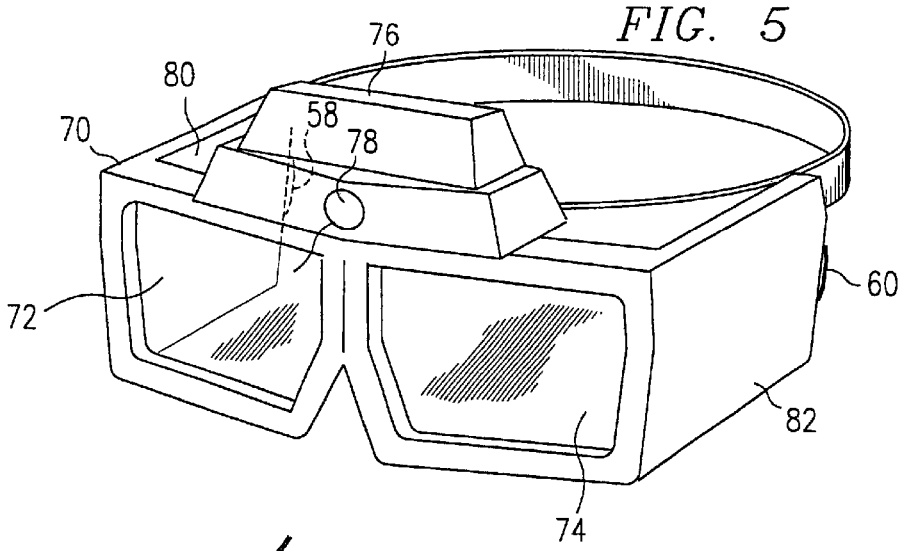
FIG. 5 illustrates a perspective view of the support mechanism for these speakers.

Referring now to FIG. 5, there is illustrated a perspective view of the support mechanism for the localized speakers 58 and 60. The localized speakers 58 and 60 are supported in a pair of three-dimensional glasses 70, which are designed for three-dimensional viewing. These glasses 70 typically have LCD lenses 72 and 74 which operate as shutters to provide the three-dimensional effect. A control circuit is disposed in a housing 76 which has a photo transistor 78 disposed on the frontal face thereof The photo transistor 78 is part of a communications system that allows the synchronization signals to be transmitted to the glasses 70.

Housing 80 is disposed on one side of the glasses 70 for supporting the localized speaker 58. A housing 82 is disposed on the opposite side of the glasses 70 for supporting the localized speaker 60. The housings 80 and 82 provide the proper acoustic termination for the speakers 58 and 60, such that the frequency response thereof is optimized. The speakers 58 and 60 are typically fabricated from a dynamic loudspeaker, which is conventionally available for use in stereo headphones.

Figure 6:
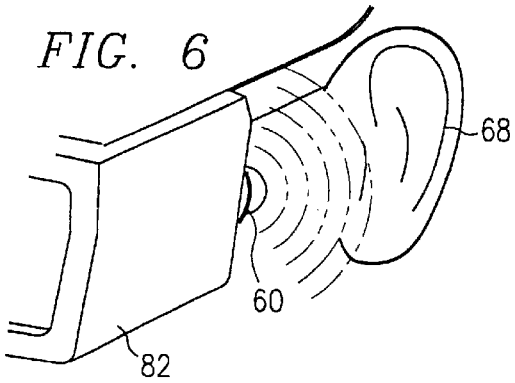
FIG. 6 illustrates a side view of the housing and the localized speaker.

Referring now to FIG. 6, there is illustrated a side view of the housing 82 and the localized speaker 60. The localized speaker 60, as described above, is disposed such that it is proximate to the side of the head in the area of the zygomatic arch. It is directed rearward toward the pinna 68 of the left ear of the listener 26 with the sound emitted therefrom being picked up by the pinna 68 and the ear canal of the left ear of the listener 26.

Figure 7:
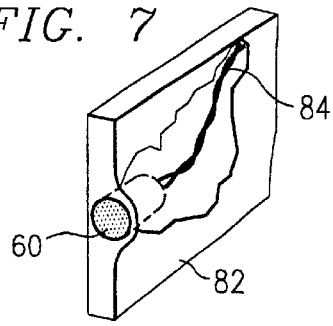
FIG. 7 illustrates a detail rear perspective view of the housing for containing one of the localized speakers.

Referring now to FIG. 7, there is illustrated a detailed view of the housing 82 and the speaker 60. The housing 82 is slightly widened at the mounting point for the localized speaker 60, which, as described above, is a small dynamic loudspeaker. A wire 84 is provided which is disposed through the housing 82 up to the control circuitry in the housing 76. Alternatively, the wire 84 can go to a separate control/driving circuit that is external to the housing 82 and the glasses 70. The housing 82 is fabricated such that it has a cavity disposed therein at the rear of the localized speaker 60. The size of this cavity is experimentally determined and is a function of the particular brand of dynamic loudspeaker utilized for the localized speakers 58 and 60. This cavity is determined by measuring the response of the particular dynamic loudspeaker with a variable cavity disposed on the rear side thereof. This cavity is varied until an acceptable response is achieved.

Figure 8:
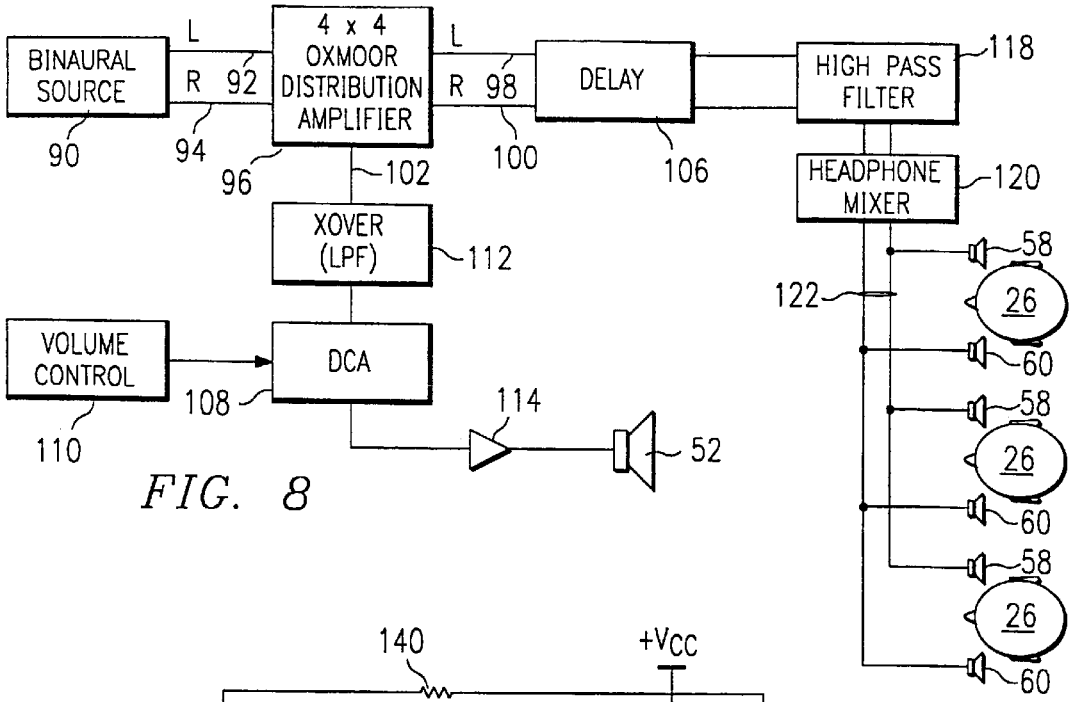
FIG. 8 illustrates a schematic block diagram of the system for generating the localized speaker driving signals.

Referring now to FIG. 8, there is illustrated a schematic block diagram of the system for driving the localized speakers 58 and 60 and also the low frequency speaker 52. The binaural recording system typically provides an output from a tape recording, which is played back and output from a binaural source 90 to provide left and right signals on lines 92 and 94. These are input to a 4×4 circuit 96 that outputs left and right signals on lines 98 and 100 for localized speakers 58 and 60, and also a summed signal on a line 102, which comprises the sum of both the left and right signals. The 4×4 circuit 96 is manufactured by OXMOOR CORPORATION as a Buffer Amplifier and is operable to receive up to four inputs and provide up to four outputs as any combination of the four inputs or as the buffered form of the inputs. The signal line 102 is output to a crossover circuit 112 which is essentially a low pass filter. This rejects all signals above approximately 250 Hz. The crossover circuit 112 is typical of Part No. AC 22, which is a stereo two-way crossover, manufactured by RANE CORPORATION. The output of the crossover 112 is input to a digital control amplifier (DCA) 108 to control the signal level. This is controlled by volume level control 110. The DCA 108 is typical of Part No. DCA-2, manufactured by OXMOOR CORPORATION. The output of the DCA 108 is input to an amplifier 114 which drives the speaker 52 with the low frequency signals. The amplifier 114 is typical of Part No. 800X, manufactured by SONICS ASSOCIATES, INCORPORATED.

The left and right signals on lines 98 and 100 from the 4×4 circuit 96 are input to a delay circuit 106, which is typical of Part No. DN775, which is a Stereo Mastering Digital Delay Line, manufactured by KLARK-TEKNIK ELECTRONICS INC. The outputs of the delay circuit 106 are input to a high pass filter 118 to reject all frequencies lower than 250 Hz. The high pass filter 118 is identical to the part utilized for the crossover circuit 112. The outputs of filter 118 are input to a headphone mixer 120 to provide separate signals on a multiplicity of lines 122, each set of lines comprising a left and a right line for an associated set of localized speakers 58 and 60 for listeners 26. This is typical of Part No. HC-6, which is a headphone console, manufactured by RANE CORPORATION. The lines 122 are routed to particular listeners' localized speakers 58 and 60.

Figure 9:
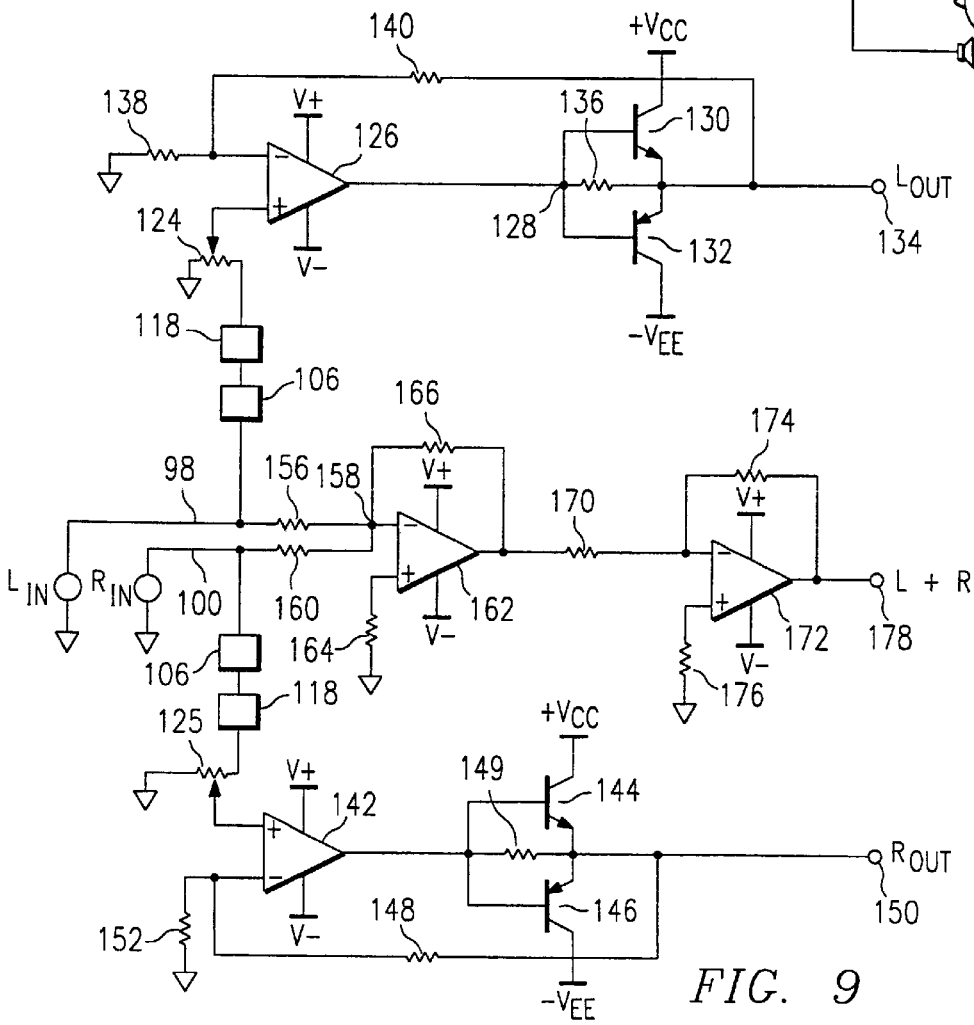
FIG. 9 illustrates a schematic diagram for generating the signals for driving the localized speakers.

Referring now to FIG. 9, there is illustrated a detailed schematic diagram of the circuit for driving the headphones. Line 98 is input through delay 106, and high pass filter 118 to the wiper of a volume control 124, the output of which is input to the positive input of an operational amplifier (op amp) 126. The output of op amp 126 is connected to a node 128 which is also connected to the base of both an NPN transistor 130 and a PNP transistor 132. Transistors 130 and 132 are configured in a push-pull configuration with the emitters thereof tied together and to an output terminal 134. The collector of transistor 130 is connected to a positive supply and the collector of transistor 132 is connected to a negative supply. The emitters of transistors 130 and 132 are also connected through a resistor 136 to the node 128. The negative input of the op amp 126 is connected through a resistor 138 to ground and also through a feedback resistor 140 to the output terminal 134.

An op amp 142 is provided with the positive input thereof connected to the output of volume control 125. The wiper of volume control 125 is connected through delay 106 and the filter 118. Op amp 142 is configured similar to op amp 126 with an associated NPN transistor 144 and PNP transistor 146, configured similar to transistors 130 and 132. A feedback resistor 148 is provided, similar to the resistor 140, with feedback resistor 148 connected to the negative input of op amp 142 and an output terminal 150. A resistor 152 is connected to the negative input of op amp 142 and ground. The volume controls 124 and 125 provide individual volume control by the listener 26.

Line 98 is also illustrated as connected through a summing resistor 156 to a summing node 158. Similarly, the line 100 is connected through a summing resistor 160 to the summing node 158. The summing node 158 is connected to the negative input of an op amp 162, the positive input of which is connected to ground through a resistor 164. The negative input of op amp 162 is connected to the output thereof through a feedback resistor 166. Op amp 162 is configured for unity gain at the first stage. The output of op amp 162 is connected through a resistor 170 to a negative input of an op amp 172. The negative input of op amp 172 is also connected to the output thereof through a resistor 174. The positive input of op amp 172 is connected to ground through a resistor 176. Op amp 172 is configured as a unity gain inverting amplifier. The output of op amp 172 is connected to an output terminal 178 to provide the sum of the left and right channels. The op amps 162 and 172 provide the function of the summing portion of 4×4 circuit 96, and are provided by way of illustration only.

Figure 10:
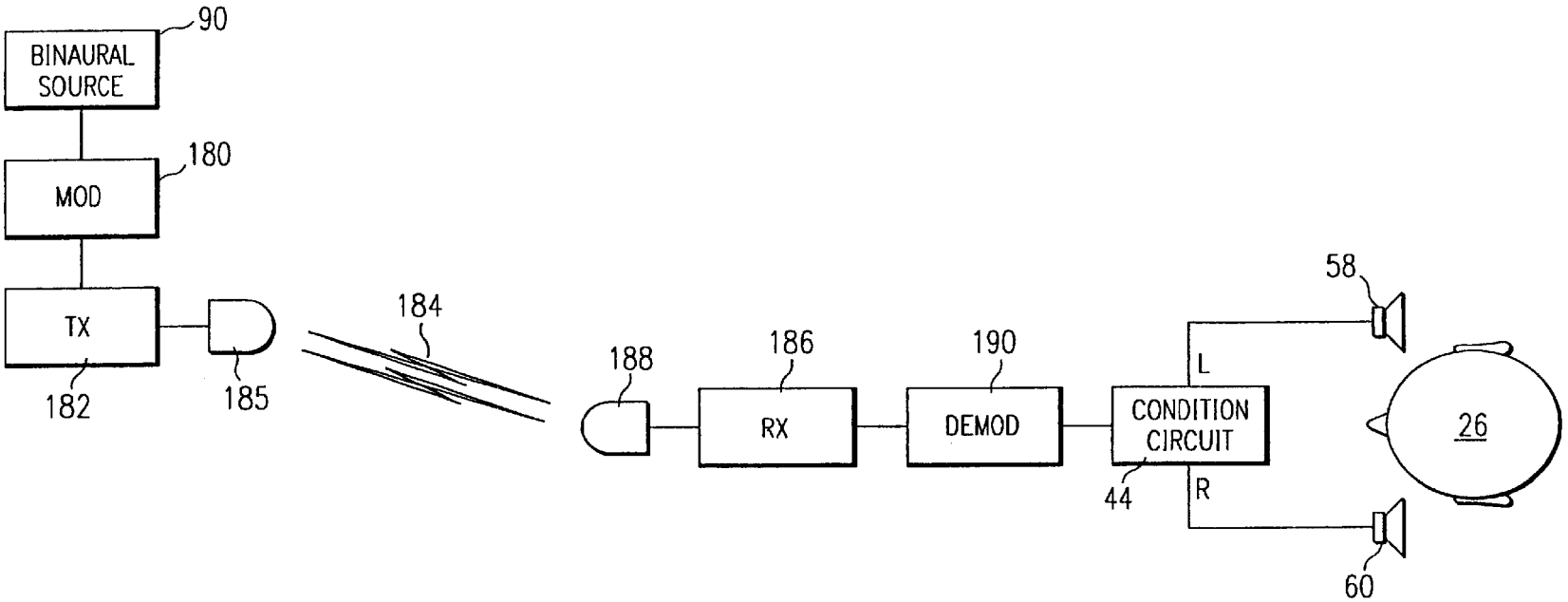
FIG. 10 illustrates a block diagram of an alternate method for transmitting the binaural signals to the listener over a wireless link.

Referring now to FIG. 10, there is illustrated a block diagram of an alternate method for transmitting the left and right signals to the localized speakers 58 and 60. The binaural source has electronic signals modulated onto a carrier by a modulator 180, the carrier then transmitted by transmitter 182 over a data link 184. The data link 184 is comprised of an infrared data link that has an infrared transmitting diode 185 disposed on the transmitter 182. A receiver 186 is provided with a receiver Light Emitting Diode 188 that receives the transmitted carrier from the diode 185. The output of the receiver 186 is demodulated by a demodulator 190 and this provides a left and right signal for input to the conditioning circuit 44.

Figure 11:
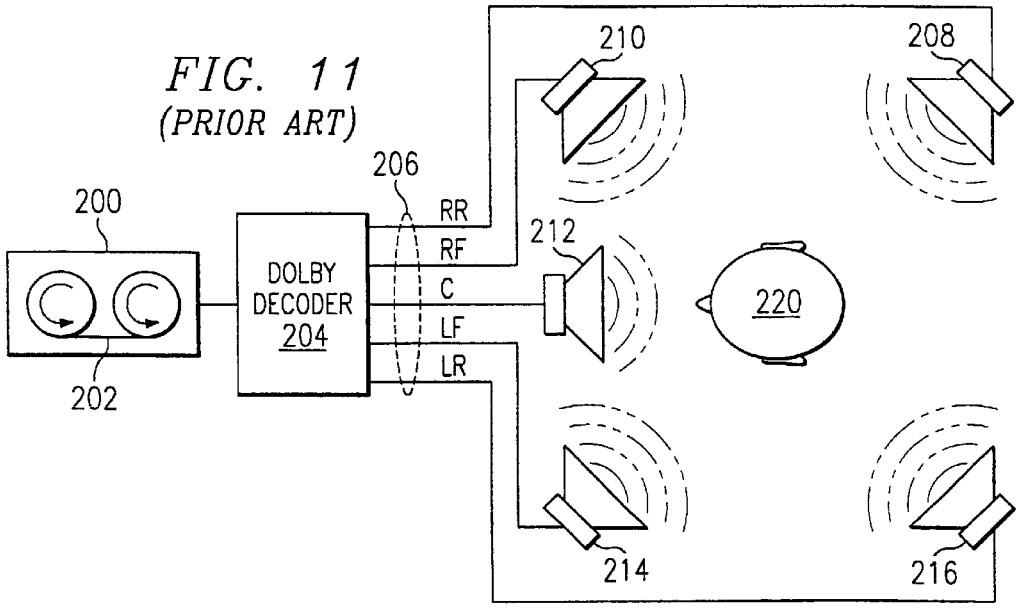
FIG. 11 (PRIOR ART)
FIG. 11 illustrates a diagrammatic view of a prior art surround sound system.

Referring now to FIG. 11, there is illustrated a prior art surround sound system. A conventional VCR 200 is provided which is operable to play a VCR tape 202. The VCR tape 202 is a conventional tape which has both video and sound disposed thereon. The soundtrack that is recorded is encoded with a Dolby® surround sound format such that there are typically five channels encoded thereon, a center front channel, a left front channel, a right front channel, a left rear channel and a right rear channel. Each of these is associated with a sound that is to be output from corresponding speakers. However, the VCR only outputs left and right channels and this is input to a Dolby® surround sound decoder 204 to provide the five decoded signals on line 206. The decoded signals are input to associated speakers, with the right rear signal directed to a right rear speaker 208, the right front signal directed to a right front speaker 210, the center front signal directed to a center front speaker 212, the left front signal directed to a left front speaker 214 and the left rear signal directed to a left rear speaker 216. The sound is positioned in a conventional manner such that a listener 220 disposed in the center of the speakers 208–216 will obtain the proper effect. However, if a listener moves to one side or the other, as is typical with a movie theater, a different effect will be achieved.

Figure 12:
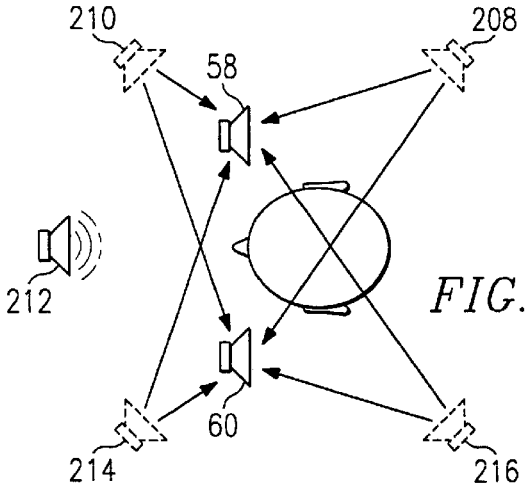
FIG. 12 illustrates a diagrammatic view of the head mounted surround sound system of the present invention for emulating the front and rear speakers.
Figure 13:
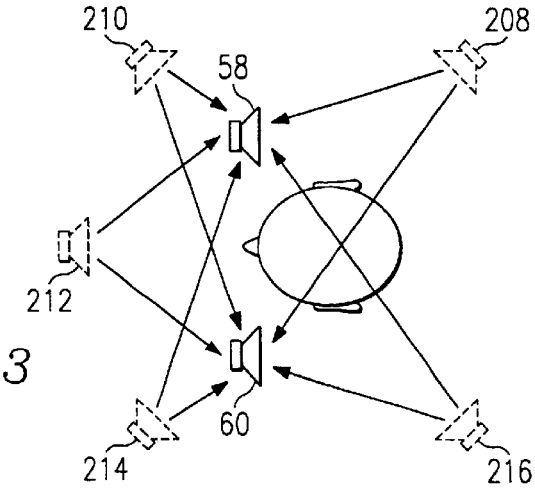
FIG. 13 illustrates a diagrammatic view of the head mounted system of the present invention for emulating the front and rear speakers and also the center speakers.

Referring now to FIG. 12, there is illustrated a diagrammatic view of the head mounted speaker system with the right speaker 58 and left speaker 60 directed rearward toward the ear of the listener with the inputs thereto binaurally mixed to emulate the right rear speaker 208, the right front speaker 210, left front speaker 214 and left rear speaker 216 with respect to the positioning information associated therewith. The center front speaker 212 is maintained in front of the listener such that the listener can obtain a fix relative thereto. However, the center front speaker 212 can also be binaurally linked, as illustrated in FIG. 13. The binaural mixing will be described hereinbelow.

It can be seen that once the binarural mixing is achieved, the listener now has associated with his position a virtual relative position to each of the left and right front speakers and left and right rear speakers. Further, this relationship is not a function of the listener's position within the theater, nor is it a function of the position of the listener's head. As such, the position of the listener within the theater is no longer important, as the virtual distance to each of the speakers remains the same. Further, the reflections of the walls of the theater are now minimized. Of course, the embodiment of FIG. 12 with the center front speaker 212 disposed external allows the listener to obtain a fix to the associated video. Typically, dialogue is exclusively routed to the center front speaker 212, although some sound mixers utilize the center front speaker to obtain different effects such as blending a small portion of the other channels onto the center front speaker 212.

Figure 14:
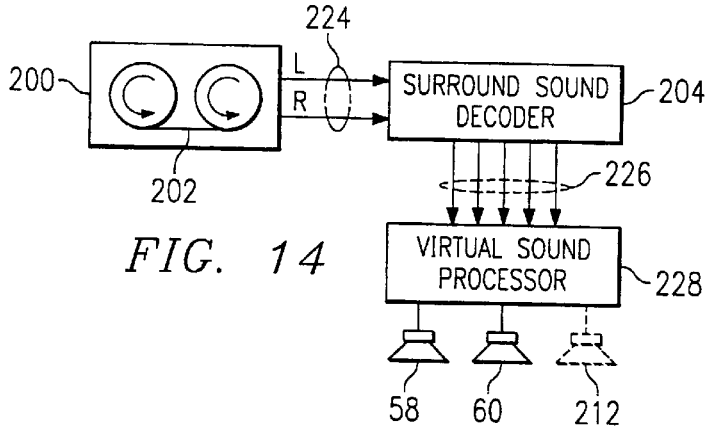
FIG. 14 illustrates a block diagram of the system for decoding the surround sound channels from a two channel VCR output and processing them to provide the inputs to the two head mounted speakers.

Referring now to FIG. 14, there is illustrated a simplified block diagram of the binaural mixing system of the present invention. The left and right outputs of the VCR 200 are provided on lines 224 to the surround sound decoder 204. The decoded outputs are comprised of five lines 226 that provide for the left front, left rear, right front and right rear speakers and the center front speaker. These are input to a virtual sound processor 228, which is operable to mix these signals for output on the speakers 58 and 60 and, preferably, to the center front speaker 212, which is illustrated in virtual to illustrate that this also could be mixed into the speakers 58 and 60. However, the preferred embodiment allows the center front speaker 212 to be separate.

The virtual sound processor 228 is a binaural mixing console (BMC), which is manufactured by Head Acoustics GmbH. The BMC is utilized to provide for binaural post processing of recorded mono and stereo signals to allow for binaural room simulation, the creation of movement effects, live recordings in auditoria, ancillary microphone sound engineering when recording with artificial head microphones and also studio production of music and drama. This system allows for virtual sound storage locations and reflections to be binaurally represented in real-time at the mixing console. Any sound source can be converted into a head-related signal. The BMC utilized in the present invention provides for three-dimensional positioning of the sound source utilizing two speakers, one disposed adjacent each ear of the listener. The controls on the BMC are associated with each input and allow an input sound source to be positioned anywhere relative to the listener on the same plane as the listener, or above and below the listener. This therefore gives the listener the impression that he or she is actually present in the room during the original musical performance. With the use of this system, the usual "in-head localization", which reduces listening pleasure in standard stereo reproduction, is removed. The operation of the BMC is described in the *BMC Binaural Mixing Console Manual*, published November 1993 by Head Acoustics, which manual is incorporated herein by reference.

Figure 15:
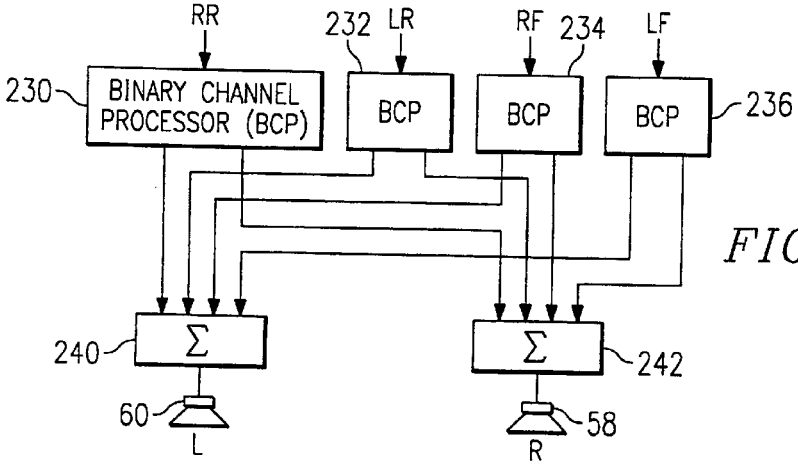
FIG. 15 illustrates a detail of the binary channel processor.

Referring now to FIG. 15, there is illustrated a block diagram of the BMC virtual sound processor 228. Each of the decoded signals for the right rear, left rear, right front and left front speakers are input through respective binaural channel processors (BCP) 230, 232, 234 and 236. Each of the BCPs 230–236 is operable to process the input signal such that it is positioned relative to the head of the listener via speakers 58 and 60 for that signal. The output of each of the BCPs 230–236 provide a left and right signal. The left signal is input to a summing circuit 240 and the right signal is input to a summing circuit 242. The summing circuits 240 and 242 provide an output to each of the speakers 60 and 58, respectively.

Figure 16:
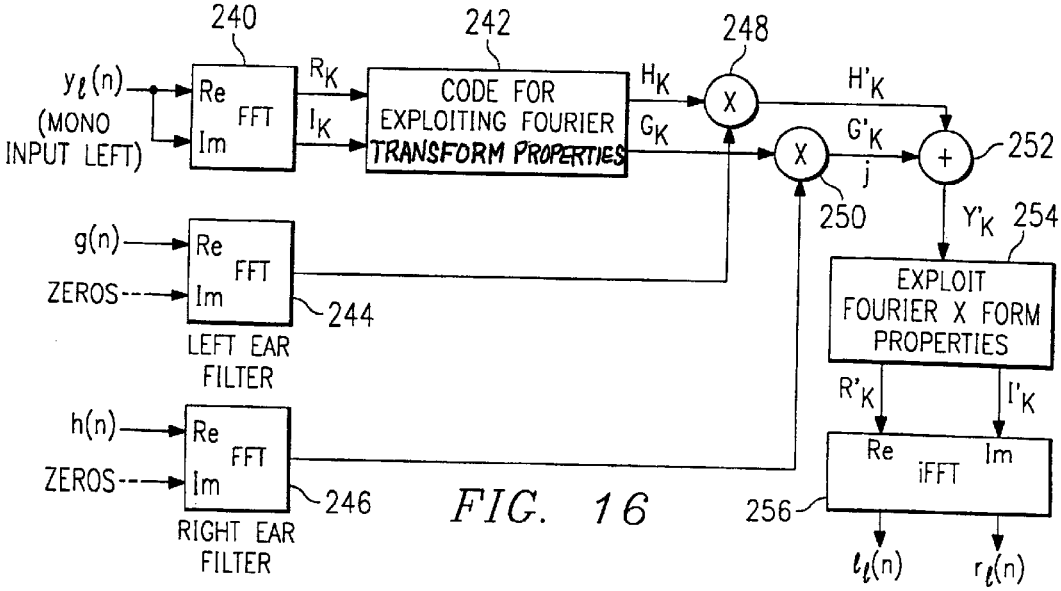
FIG. 16 illustrates a block diagram of a convolver for impressing the impulse response of a given theater or surrounding onto the decoded signals.

Referring now to FIG. 16, where is illustrated a block diagram of a system for providing real-time convolution in order to convolve the impulse response of a given environment, such as a theater. In addition to providing the surround sound system, it is also desirable to provide the surround sound system in conjunction with the acoustics of a given theater. Some theaters are specifically designed to facilitate the use of surround sound and they actually enhance the original surround sound of the audio track. This convolution may be performed directly in the computer in the time domain which, however, is a slow process unless some type of special computer architecture is utilized. Normally, convolution is usually in the form of its frequency domain equivalence since the Fourier transformation of the audio signal and impulse response, followed by the multiplication and inverse fast Fourier transformation of the result are faster than direct convolution. This method can be implemented with software or hardware. This type of convolution is often performed using a computer coupled to an array processor, the advantage being that input signals and room impulse responses may be arbitrarily long, limited only by the computer hard disk space. However, the disadvantage of the system is that the processing time of the impulse response is comparatively long. The present invention utilizes a digital signal processor (DSP) as a signal processor to provide a digital filter that can convolve a multiple channel impulse response and a predetermined sampling frequency in real time with only a few seconds of delay. One type of real-time convolver is that manufactured by Signal Logic Inc., which allows the user to perform either mono or binaural audible simulations ("auralizations") in real-time using off-the-shelf DSP/analog boards and multimedia boards. The filter inputs are typically any impulse response.

Referring further to FIG. 16, the transformation provided for convolving an input signal with an impulse response is illustrated with respect to the mono input to the left ear, the same diagram applying for the right ear. A fast Fourier transform device 240 is provided for receiving the real and imaginary parts of the mono input $y_1(n)$ and provides the fast Fourier transform of real and imaginary components $R_K$ and $I_K$. These are input to a processor 242 that is operable to contain the code for exploiting the Fourier transform properties to further process the Fourier transform. This provides on the output, the values $H_K$ and $G_K$. The impulse response $h_1(n)$ is input to the real input of a fast Fourier transform block 244, the imaginary input connected to a zero input. This provides a complex output that is multiplied by the value $H_K$ in the multiplication block 248, providing the output of the process value $H_K$. The fast Fourier transform block 244 provides the filter function for the left ear. The right ear filtering operation is provided by a fast Fourier transform block 246, which receives the impulse response $h_2(n)$ on the real input and zeroes on the imaginary input. The output of the fast Fourier transform block 248 is input in multiplication blocks 250 for multiplication by the value $G_K$, providing on the output thereof the processed value $G'_K$. The value $H'_K$ and the value $G'_K$ are added in a summation block 252 to provide the value $Y'_K$, which is input to another processor 254 to exploit the Fourier transform properties thereof to provide on the output a real imaginary component $R'_K$ and $I'_K$. These are input to the input of a fast Fourier transform block 256 to provide on the output the values $1_1(n)$ and $r_1(n)$, where $1_1(n)$ is the left portion of the signal for a source originating from the left and $r_1(n)$ is a signal that is input to the right ear that originated from the left. The algorithm implemented here is a conventional algorithm known as the "Overlap-Add" method.

It is noted that the fast Fourier transform blocks 244 and 248 provide the left and right ear filters, respectively, perform the transform once at run time and the results thereof stored. Thus, only one fast Fourier transform operation is performed, followed by subsequent processing, which is followed by an inverse fast Fourier transform, all of which is performed in real-time. Improved performance is achieved by using the real and imaginary inputs to the FFT 240 and IFFT 256 blocks. The process illustrated by this is repeated for the right mono input channel to produce the values $1_r(n)$ and $r_r(n)$.

Figure 17:
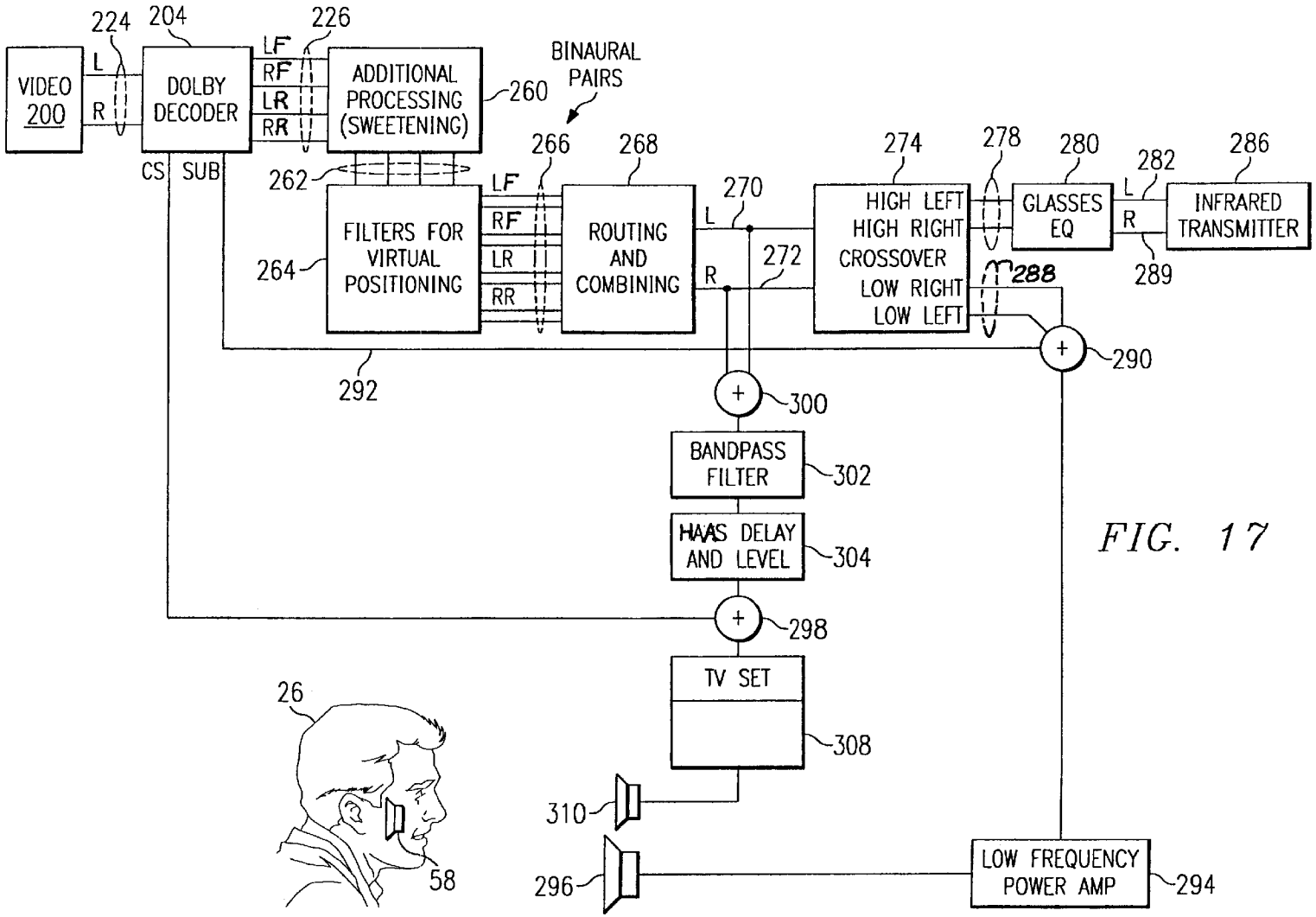
FIG. 17 illustrates an overall block diagram of the system of the present invention.

Referring now to FIG. 17, there is illustrated an overall block diagram of the system. The surround sound decoder 204 is operable to output the left front, right front, left rear and right rear signals on the lines 226 to a processing block 260 in order to provide some additional processing, i.e., "sweetening". This provides the modified decoded output signals on lines 262 for input to the binaural processing elements in a block 264 which basically provides the virtual positioning of each of the decoded output signals. This provides on the output thereof four signals on lines 266 that are still separate. These are input to a routing and combining block 268 that is operable to combine the signals on lines 266 for output on either a left speaker line 270 or a right speaker line 272. The functions provided by the blocks 264 and 268 are achieved through the binaural mixing console (BMC) 228 described hereinabove with respect to FIGS. 14 and 15.

The signals on lines 270 and 272 are input to a crossover circuit 274 which is operable to extract the left and right signals above a certain threshold frequency for output on two lines 278 for input to an equalizer circuit 280. Equalizer circuit 280 is operable to adjust the frequency response in accordance with a predetermined setting and then output to the drive signals on a left output line 282 and a right output line 284, these input to an infrared transmitter 286. Infrared transmitter 286 is operable to transmit the information to the glasses as described hereinabove.

The output of the crossover circuit 274 associated with the lower frequency components provides two lines 288 which are input to a summation circuit 290. This summation circuit 290 is operable to sum the two lines 288 with the subwoofer output of the decoder 204, this being a conventional output of the decoder, which output was derived from the original soundtrack in the videotape. This subwoofer output is on line 292. The output of summation circuit 290 is input to a low frequency amplifier 294 which is utilized to drive a low frequency speaker 296.

The center speaker output from the decoder 204 is input to a summation circuit 298, the summation circuit 290 also operable to receive a processed form of the signal that is input to the left and right ear of the left and right speakers 58 and 60 of the glasses. The signals on the lines 270 and 272 are input to a summation circuit 300, the summed output thereof input to a bandpass filter 302 and to a Haas delay circuit 304. This effectively blends the output of the headset with a delay for output on the speaker 310 such that the listener will not lock the portion of the audio in the control speaker that was derived from the signals to the headset. The input to the summation circuit 300 could originate from the LF and RF outputs of the decoder 204 to enhance frontal localization. The output of the Haas delay circuit 304 is input to the summation circuit 298. The output of the summation circuit 298 is input to a conventional driving device such as a TV set 308, which drives a central speaker 310. The listener 26 can then be disposed in front of the speaker 310 and receive over the infrared communication link the surround sound encoded signals from the infrared transmitter 286.

In the virtual sound processing system disclosed hereinabove, e.g., FIGS. 13 and 14, sound sources are virtually positioned in three dimensions utilizing playback of binauralized left and right sound signals via a localized speaker headset 58, 60 in FIG. 13. A center front speaker 212 (FIG. 12) may be used to improve the perception of vocal material or low frequency material, for example, as described. It was also mentioned hereinabove in conjunction with FIG. 13 that blended signals may also be coupled to the center front speaker 212. It is well known that sound from a front center speaker operates to fill in the middle portion of a left-right stereo image. Blended signals may also be used to enhance the frontal localization and virtual positioning definition of the sound images of a video program wherein the center speaker 212 provides these enhancements in addition to enabling the listener to "fix" upon the position of the center speaker 212 as the reference, with respect to which the reproduced sound field remains stable and coherent vis-a-vis the video program, regardless of the listener's movements in the listening area.

Further experimentation has been shown that, in listening environments when headphones are used, e.g. the localized headset and system described hereinabove, by feeding a blended signal to a center channel speaker that includes a phase-shifted component, the apparent position of the center front image may be predictably moved along a longitudinal or near-far axis between the listener and the fixed center front speaker. Thus, new possibilities for enhancing the overall sound image when listening via a localized headset may be exploited.

Although many possibilities exist for processing stereo sound signals to produce a blended signal (or signals) to enhance the function of a center front loudspeaker, the illustrative example described hereinbelow represents but one way in which a blended signal, center speaker component of a sound reproduction system may be devised. In brief from the front left and right signals obtained during the processing necessary to develop the binauralized signals fed to the localized speaker (headset) system is generated a blended signal through combinations of comb filtering, summing blocks and gain and/or blending controls. Generally, in order to preserve the full bandwidth and spectra of the original signals in the center channel, processing of the signal(s) is required, as in this illustrative example, through a comb filtering process. In some embodiments the summing step will be performed first (see FIGS. 21 and 22). In other embodiments the (comb) filtering processing will be performed first (see FIGS. 20,23 and 24). These functions, which may be implemented through analog or digital (e.g., DSP) circuitry are configured in this example to produce pseudo stereo signals from a monaural (summed from left and right inputs) signal which are then blended to provide a drive signal for a center front speaker. This drive signal may be adjusted to mitigate some of the sensations often experienced with headset playback systems characterized as "in the head" or which result in ambiguous localization or "too wide" a sound image and the like. For example, ambiguous localization may occur along both the lateral axis (left-to-right, e.g., across the front between the left and right front speakers) and the longitudinal axis (center front-to-listener) wherein the apparent position of the sound image between the listener's position and the center of the video screen is ambiguous or departs from what may seem natural to the listener.

The signals to be blended in this illustrative example may be obtained by comb filtering each channel of a stereo signal or a monaural signal as described in the article "A Rational Technique For Synthesizing Pseudo-Stereo From Monophonic Sources" by Robert Orban published in the *Journal of the Audio Engineering Society* April, 1970, vol. 18, No. 2, pp. 157–164. The comb filters, which provide the needed delay or phase shift without significantly altering the frequency power band-pass, may be implemented in analog circuitry as described in this article or by the use of digital signal processing devices. A brief overview of digital comb filters is provided in Chapter 13 of *Principles of Digital Audio*, Second Edition, by Ken C. Pohlmann, published in 1989 by the Howard B. Sams & Co. Division of Macmillan, Inc. It will be appreciated by those skilled in the art, however, that other devices for providing delay or phase shift, or other forms of signal processing or kinds of signals may be used to generate the blended signal for playback over the center speaker/localized speaker headset system described in the present disclosure.

Figure 18:
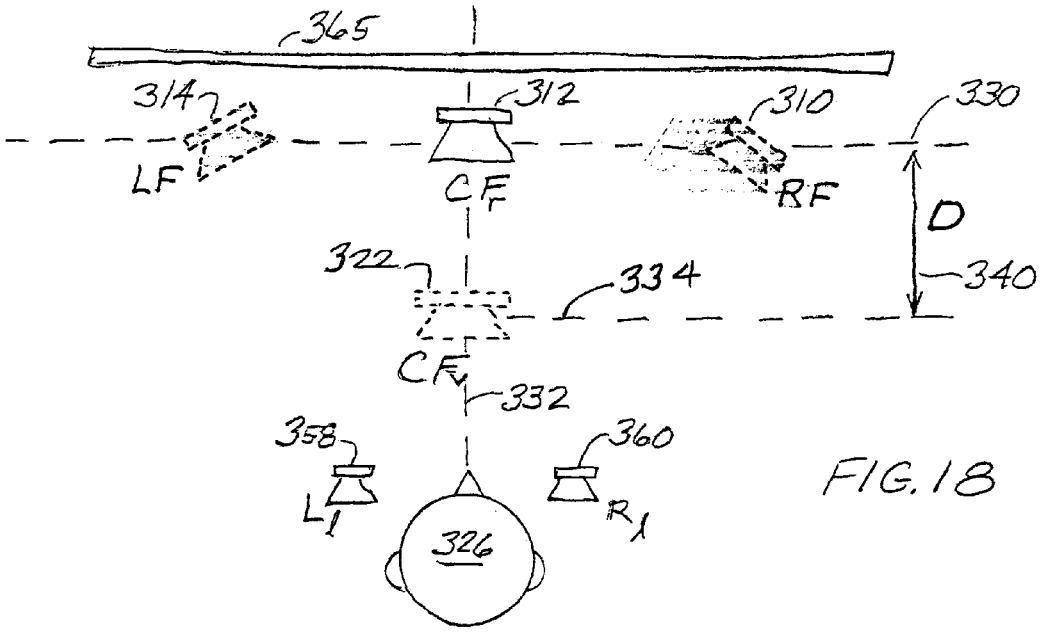
FIG. 18 illustrates a plan view of a portion of the listening environment during reproduction of a sound program having center channel enhancement according to the present disclosure.

Referring now to FIG. 18, there is illustrated a plan view of a portion of the listening environment during the reproduction of the sound program having center channel enhancement according to the present disclosure. The portion of the listening environment shown includes a virtual right front speaker 310, a center front speaker 312 and a virtual left front speaker 314 aligned substantially in a row indicated by lateral axis 330 (shown as a dashed line) passing in front of a video screen 365. The virtual right 310 and virtual left 314 front speakers are shown in FIG. 18 in their apparent positions as perceived via the left 358 and right 360 localized speakers worn by the listener. In practice, the actual position of the lateral axis 330 may be aligned substantially with or just behind the video screen 365 relative to the position of the listener 326. A virtual speaker position for the center front speaker is shown positioned approximately midway between the center front speaker 312 and the listener position 326 along a longitudinal axis 332. The longitudinal axis 332 (shown as a dashed line) passes through the listener position 326 and the center front speaker 312 to define the locus of apparent positions of a virtual image 322 to be described hereinbelow. In FIG. 18, the position of the virtual image 322 is indicated by the dashed line 324 which runs parallel to the lateral axis 330 and is separated from the lateral axis 330 by a distance D indicated by the reference number 340. As will be described hereinbelow, the distance D 340 may vary according to the particular processing of the signals fed to the center front speaker and to a localized speaker system of the headset worn by the listener 326. Although the headset itself is not shown in FIG. 18 for clarity, the localized speakers carried by the headset include the left localized speaker 358 and the right localized speaker 360 as shown in FIG. 18. These localized speakers 358, 360 are placed substantially in the plane of the zygomatic arch of the listener 326 and proximate the respective ear of the listener 326 as previously described. In this context, the term proximate means that the respective localized speaker is placed near the respective ear but is not covering or touching or otherwise in contact with the respective ear of the listener 326 as described hereinabove in conjunction with FIG. 4. The plan view shown in FIG. 18 illustrates the principal structures which are pertinent to the center channel enhancement which is the subject of the present disclosure.

Figure 19:
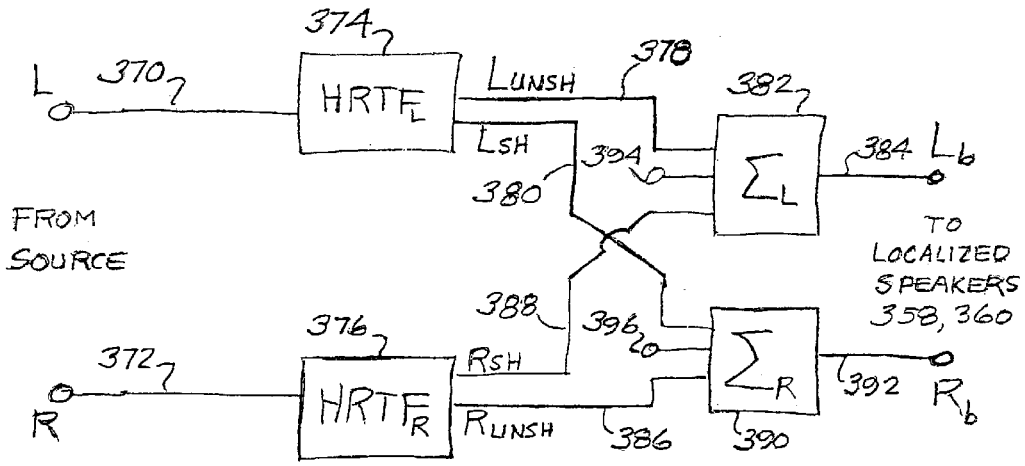
FIG. 19 illustrates a block diagram of one embodiment of the virtual sound processing of left and right source signals for use with a localized speaker headset according to the present disclosure.

Referring now to FIG. 19, there is illustrated a block diagram of one embodiment of the virtual sound processing of the front left and right sound signals for use with a localized speaker headset according to the present disclosure. The processing to be described hereinbelow begins with left and right stereo signals from a source of program material, typically a video program or a film. Alternatively, LF and RF signals output from the Dolby decoder 204 in FIG. 17 may be used, for example, to generate signals suitable for driving the localized speakers 358, 360 of FIG. 19, which are supported by the headset worn by a listener 326. These signals, when played back through the localized speakers 358, 360, reproduce sound which apparently emanates from virtual speaker locations disposed around the space of the listening environment. This example is representative of various ways in which virtual sound processing may be accomplished for use with a surround sound reproduction system where each listener wears a headset having the localized loudspeakers 358, 360 supported thereby. In the present disclosure, the center channel enhancements described hereinbelow are intended to be used in conjunction with such virtual sound processing described in FIG. 19.

Continuing with FIG. 19, the left sound signal 370 is coupled to the input of a processing block called a head related transfer function ($HRTF_L$) 374 which provides two output signals. A first output signal called a left, unshadowed ($L_{UNSH}$) signal 378 replicates the signal in a live listening environment that would be perceived by the left ear of the listener 326. A second output signal provides left shadowed ($L_{SH}$) signal 380, which replicates the signal emanating from the left speaker source and perceived by the right or shadowed ear of the listener 326. The left unshadowed signal 378 is provided to an input of a summing block 382 denoted $\Sigma_L$. The output of the summing block 382, $\Sigma_L$, is provided along path 384 to a terminal labeled $L_b$. Similarly, the left shadowed signal 380 is provided to an input of another summing block 390 denoted $\Sigma_R$ which appears in the right output of the virtual sound processor illustrated in FIG. 19. The output from the summing block 390, $\Sigma_R$, is provided along path 392 to a terminal $R_b$. The signals from a terminal $L_b$ and a terminal $R_b$ are coupled to the localized speakers 358, 360 respectively. Returning to the input of the virtual sound processing apparatus of FIG. 19, the right channel signal from the program source is provided along 372 to a head related transfer function ($HRTF_R$) block 376 which also provides first and second outputs. A first output, $R_{UNSH}$, 386 (right channel, unshadowed) is provided to an input of the summing block 390 denoted $\Sigma_R$. A second output $R_{SH}$, 388 (right channel, shadowed) is provided to an input of a left summing block 382 denoted $\Sigma_L$. Thus, each summing block 382 and 390 sums inputs from each of the left and right head related transfer function blocks 374 and 376 respectively to provide the processed signals suitable for driving the localized speakers 358 and 360. Each summing block 382, 390 has an additional input 394 for summing block 382 and an input 396 for summing block 390, which will be described for another purpose hereinbelow.

In FIGS. 20, 21, 22, 23 and 24 are illustrated several embodiments of the processing of front left and right sound source signals for generating blended center channel signals according to the present disclosure. These blended center channel signals, which are generated in processing circuits of varying complexity, will be used in combination with the virtual sound processing represented by the illustrative embodiment described for FIG. 19. Head related transfer functions are well described in the prior art and in the literature and will not be described further herein other than to suggest two sources of head related transfer function data. One source is to derive the functions from measurements which may be obtained with microphones mounted in a mannequin shaped like a human head with the microphones disposed within the respective left and right ear canals of the mannequin. A second source of research data may be found in publications describing research conducted by industry or the National Aeronautics and Space Administration of the United States government. It should also be pointed out that the center channel enhancement techniques described herein must be utilized with the playback of the appropriate virtual sound processing signals through the localized speaker headset in order to provide the virtually positioned sound images which define the sound field perceived by the listener 326 in the listening environment described hereinabove.

Figure 20:
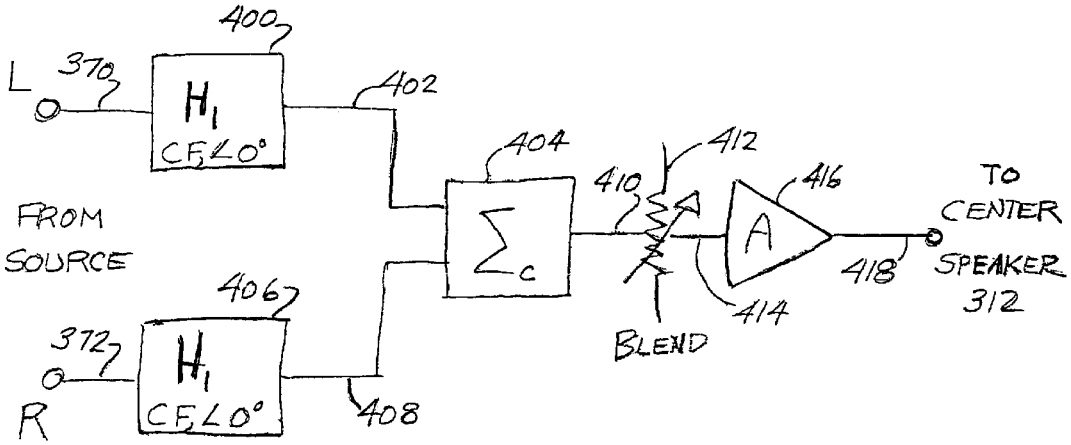
FIG. 20 illustrates a block diagram of one embodiment of the processing of left and right source signals to generate a blended center channel signal according to the present disclosure.

Referring now to FIG. 20, there is illustrated a block diagram of one embodiment of the processing of left and right source signals used for generating a blended center channel signal according to the present disclosure. A left signal 370 from the source is coupled to an input of a processing network 400 designated $H_1$ which provides an output of the processed left signal along path 402 to an input to summing block 404 designated $\Sigma_C$ for the center channel. The output of the summing block 404, $\Sigma_C$, is coupled along path 410 through a blend adjustment control 412 and from there along a path 414 to an input of an amplifier 416 having a gain A. The output of the amplifier 416 is provided along path 418 to the center speaker 312. The right channel signal from the source 372 is provided to an input of a processing block 406 which also has a designation $H_1$ and provides an output 408 to an input of the summing block 404. The processed left and right signals are summed in summing block 404 to provide a single blended center channel signal which is conditioned by the blend control 412 and the amplifier 416 to drive the center speaker 312. It should be appreciated that the conditioning of the blended center channel signal may vary depending on the application from merely coupling the signal to the center speaker 312 from the summing block 404 to including substantial amplification for providing direct hi-current drive to the center speaker 312. For example, some center speakers may be self-contained, i.e., be equipped with its own power amplifier and thus not require amplifier 416. In other applications amplifier 416 may be substituted with a filter having a predetermined frequency response characteristic.

Continuing with FIG. 20, the processing networks 400, 406 in this illustrative example are identical (both designated $H_1$) which in this illustrative example provides the signal processing function of a comb filter, having a phase angle $\Phi$ of 0°. The comb filter functions used in the present disclosure may be implemented by analog circuitry such as described in the aforementioned article by Robert Orban in the *Journal of the Audio Engineering Society* which employ all pass filters. Or, the comb filter may be implemented through digital signal processing as briefly outlined in Chapter 13 of the book *Principles of Digital Audio*, 2nd edition by Ken C. Pohlmann, published in 1989 by the Howard W. Sams & Co. division of McMillan, Inc.

Figure 25A:
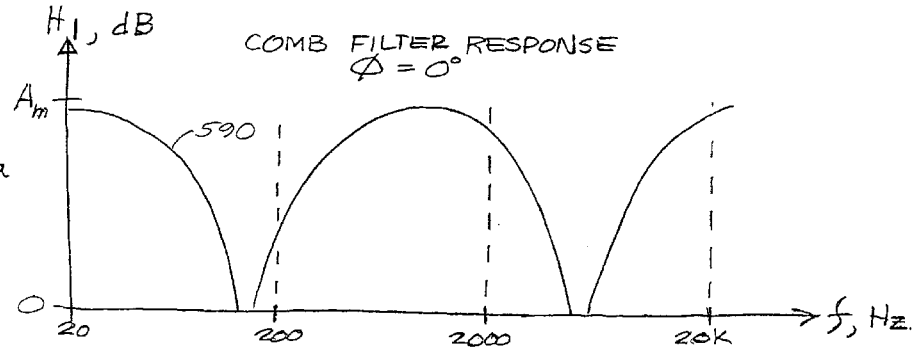
FIG. 25*a* illustrates a graph of the approximate response of one embodiment of a comb filter used in one of the processing networks $H_1$ of the present disclosure.
Figure 25B:
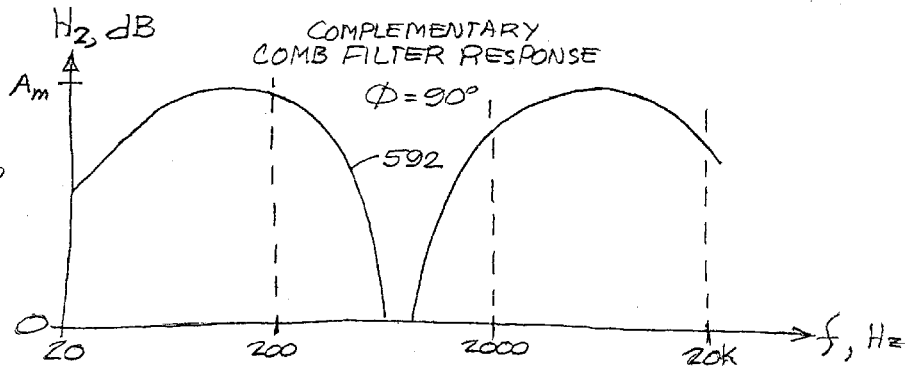
FIG. 25*b* illustrates a graph of the approximate response of one embodiment of a complementary comb filter used in another processing network $H_2$ of the present disclosure.

In the present disclosure, comb filters of two kinds are used to illustrate the principle of the present disclosure. These are described in the article by Robert Orban to provide phase shifting of components of an input signal to implement a pseudo-stereo signal derived from a monophonic source. In some of the embodiments described herein, the left and right stereo signals from the program source are summed to provide the monophonic signal from which is derived the signals to be blended for use in the center channel. In other embodiments, the left and right stereo signals are processed separately through comb filters to achieve different effects in the blending processor of the particular embodiment. In FIGS. 25*a* and 25*b* to be described hereinbelow are illustrated graphs of the approximate response of the comb filters utilized in the present disclosure. For example, the comb filter having a phase shift angle $\Phi$ of 0°, designated as comb filter $H_1$, is illustrated in FIG. 25*a*. Similarly, the complementary comb filter having a phase shift angle $\Phi$ of 90°, which is designated as complementary comb filter $H_2$, is illustrated in FIG. 25*b*.

Figure 21:
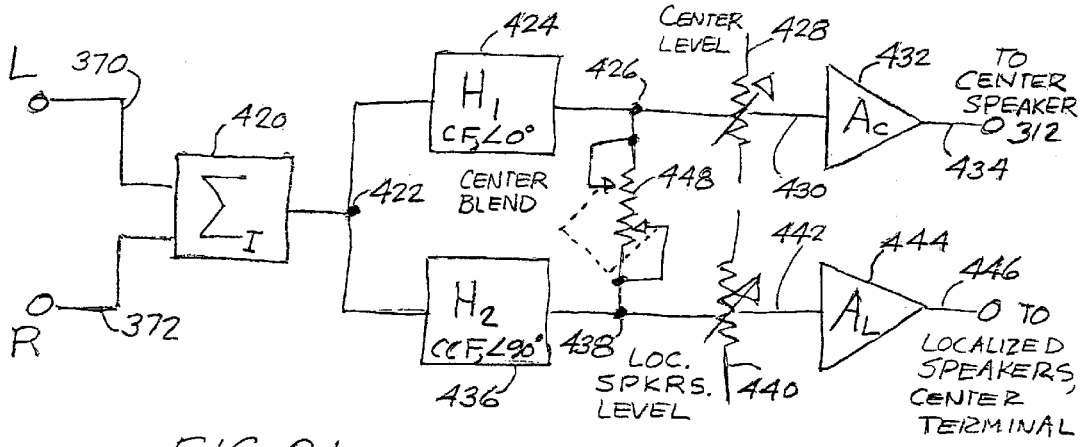
FIG. 21 illustrates a block diagram of a second embodiment of the processing of left and right source signals to generate a blended center channel signal according to the present disclosure.

Referring now to FIG. 21, there is illustrated a block diagram of a second embodiment of the processing of the left and right source signals to generate a blended center channel signal according to the present disclosure. Again, beginning with the left and right stereo signals from the programmed source 370, 372 which are input to a summing block 420 designated by $\Sigma_I$ (for summing the inputs) which provides an output to a node 422 representing a summed or monaural signal corresponding to the left and right stereo signals input from the sound program source. The monaural signal at node 422 is provided to two different processing blocks, a processing block 424 designated $H_1$ and a processing block 436 designated $H_2$. The processing block 424 designated $H_1$ is a comb filter having a phase angle $\Phi$ of 0° and provides an output at node 426. The processing block 436 designated $H_2$ is a complementary comb filter having a phase angle $\phi$ of 90° which provides an output at node 438. Each of the monaural signals from the comb filter outputs at nodes 426 and 438 respectively are fed through a level control and an amplifier to a particular output of the blending processor. From node 426 the comb filtered output of block 424 ($H_1$) is fed to a center channel level control 428 and therealong a path 430 to amplifier 432 having a gain $A_C$ which has an output 434 to be fed to the center speaker 312. Similarly, the monaural output from the complementary comb filter of block 436 ($H_2$) at node 438 is fed to a localized speaker level control 440 and along path 442 to an amplifier 444 having a gain $A_L$ which has an output 446 provided to the localized speakers headset, the center channel terminal thereof. Coupled between nodes 426 and node 438 is a center blend control 448 which has dual wipers that move in opposite directions along the resistive element to provide for blending the comb filtered monaural signal from $H_1$ and the complementary comb filtered monarual signal from $H_2$. This control allows the adjustment along the longitudinal axis 332 of the virtual center channel sound image disposed between the listener 326 and the actual front speaker 312 as illustrated in FIG. 18. The center level control 428 adjusts the volume level of the sound reproduced by the center speaker 312 and the localized speakers level control 440 adjusts the volume level of the signal representing the center channel reproduced by the localized speakers 358, 360.

Figure 22:
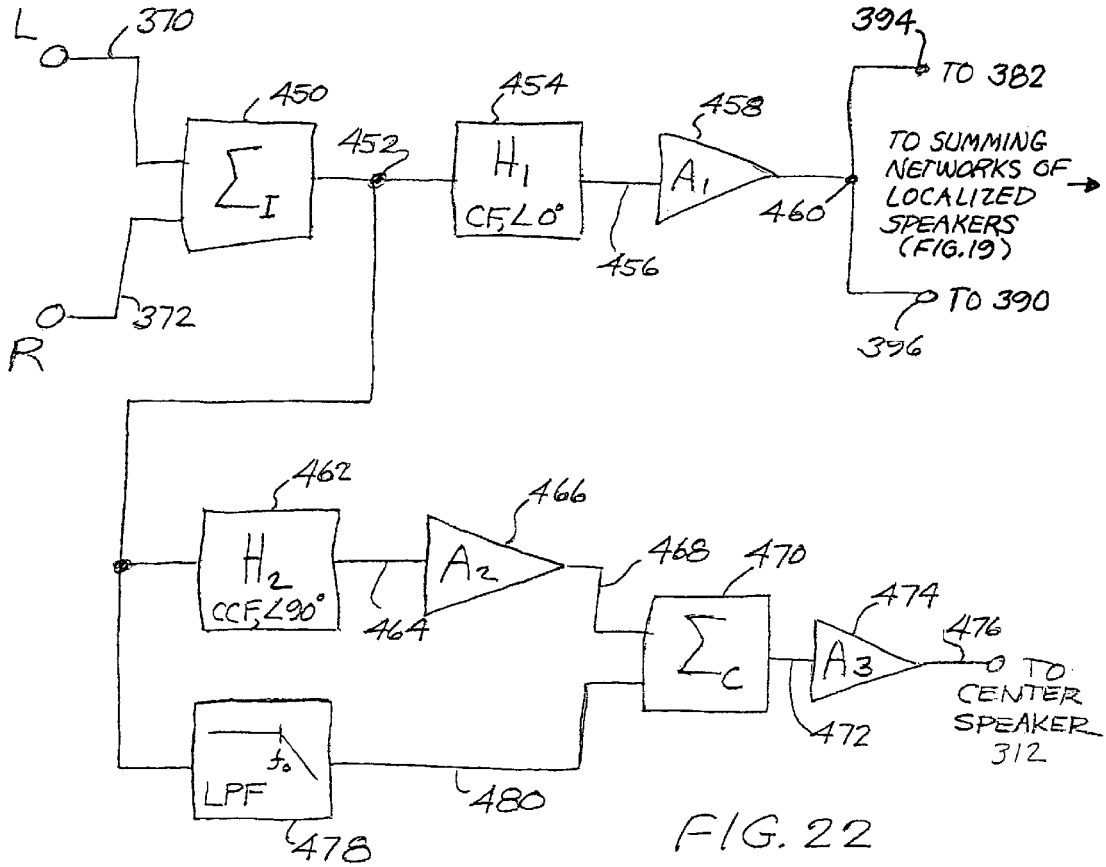
FIG. 22 illustrates a block diagram of a third embodiment of the processing of left and right source signals to generate a blended center channel signal according to the present disclosure.

Referring now to FIG. 22, there is illustrated a block diagram of a third embodiment of the processing of left and right source signals to generate a blended center channel signal according to the present disclosure. This embodiment is designed to be used particularly with the virtual sound processing circuit described in FIG. 19. The embodiment of FIG. 22 provides summed and comb filtered outputs to be fed to the unused inputs of the summing blocks in FIG. 19. The circuit of FIG. 22 begins with left and right stereo inputs 370, 372 from the sound program source to a summing block 450 designated $\Sigma_I$which provides an output to a node 452. The monaural signal at node 452 proceeds through a processing block 454 designated $H_1$ which is a comb filter providing a phase shift $\Phi$ of 0°. The output of the processing block 454 is provided along a path 456 to the input of an amplifier 458 having a gain $A_1$, which amplified output is provided to a node 460. The amplified and comb filtered signal appearing at node 460 is applied to each of the inputs 394, 396 of the respective left and right summing blocks 382, 390 of the virtual sound processing circuit of FIG. 19.

Continuing with FIG. 22, the monaural signal present at node 452 is coupled to the input of a processing block 462 designated $H_2$ which is a complementary comb filter having a phase shift $\Phi$ of 90°, and which provides an output along path 464 to the input of an amplifier 466 having a gain $A_2$. The output of the amplifier 466 is provided along path 468 to an input of a summing block 470 designated $\Sigma_C$ for center channel summing block, and coupled therefrom along path 472 to the input of an amplifier 474 having a gain of $A_3$. The output of amplifier 474 is coupled along path 476 to the center speaker 312. Returning to node 452, the monaural signal present there is also applied to the input of a low pass filter 478 and coupled therefrom along path 480 to another input of the summing block 470. The low pass filter may have a high frequency cut off designated $f_0$ which may be selected to suit a particular application and is generally chosen to coincide with the low frequency cut off of the localized speaker headset system. In a variation of the embodiment illustrated in FIG. 22, an amplifier may be inserted in the path 480 to control the amplitude of the low pass filtered signal that is applied to the summing block 470.

Figure 23:
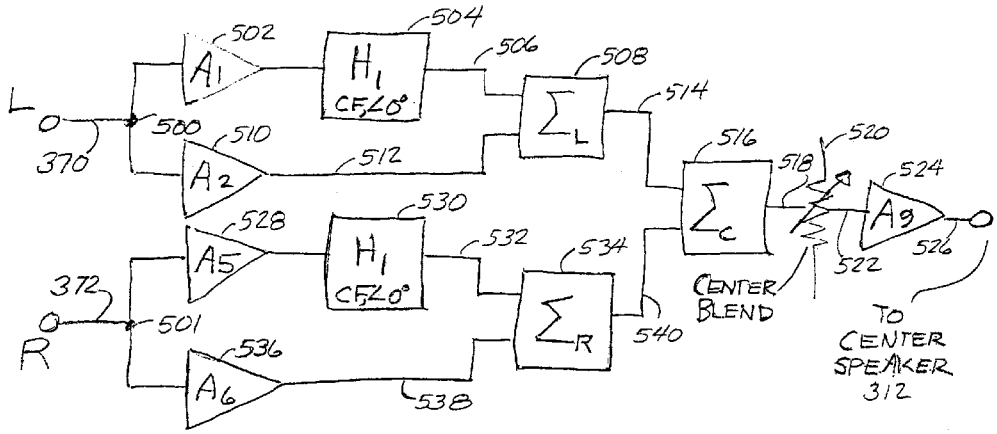
FIG. 23 illustrates a block diagram of a fourth embodiment of the processing of left and right source signals to generate a blended center channel signal according to the present disclosure.

Referring now to FIG. 23, there is illustrated a block diagram of a fourth embodiment of the processing of left and right source signals to generate a blended center channel signal according to the present disclosure. It will be recognized that the embodiment illustrated in FIG. 23 is very similar to the embodiment of FIG. 20 with the variation that in each channel the comb filtered portion of the signal is mixed with an unfiltered portion of the same signal prior to being summed together. This combined signal provides the particular channel output which is then fed to a blending circuit before being conditioned and coupled to the center speaker 312. In FIG. 23, the left sound source signal 370 is coupled to node 500 and the right sound source signal 372 is coupled to node 501. The signal at node 500 is coupled to the input of an amplifier 502 having a gain $A_1$ and coupled therefrom into an input of a processing block 504 which is designated $H_1$. In this embodiment $H_1$ is a comb filter having a phase shift $\Phi$ of 0°. The output of the processing block 504 is coupled along path 506 to an input of a summing block 508 designated $\Sigma_L$ for the left channel summing block. The output of summing block 508 is coupled along path 514 to an input of summing block 516 which is designated $\Sigma_C$ which is a center channel summing block. Returning to node 500, the signal present there is also applied to an input of an amplifier 510 having again $A_2$. The output of amplifier 510 is coupled along a path 512 to a second input of summing block 508 for combining with the comb filtered portion of the left sound source signal 370 to provide a blended left sound source signal along path 514 to a first input of the summing block 516. Similarly, returning to node 501, the right sound source signal 372 is applied to an input of an amplifier 528 having a gain $A_5$ and coupled therefrom to an input of a processing block 530 which is designated $H_1$ and is also a comb filter having a phase shift $\Phi$ of 0°. The output of the processing block 530 is applied along path 532 to a first input of a summing block 534 which is designated $\Sigma_R$. The output of summing block 534 is applied along path 540 to a second input of summing block 516. Returning to node 501, the signal present there is applied to an input of an amplifier 536 having a gain $A_6$ and the signal amplified therein is coupled along path 538 to a second input of processing block 534 for blending with the comb filtered portion of the right sound source signal 372 to provide the blended right channel signal along path 540 to a second input of the processing block 516. The output of processing block 516, having been blended together with the blended left channel signal from path 528 to provide a monaural signal along path 518, is applied to a center blend control 520 to adjust the signal level of the blended signal. The blended signal is then supplied along path 522 to an input to an amplifier 524 having a gain of $A_9$. The output of amplifier 524 is applied along path 526 to the center speaker 312.

Figure 24:
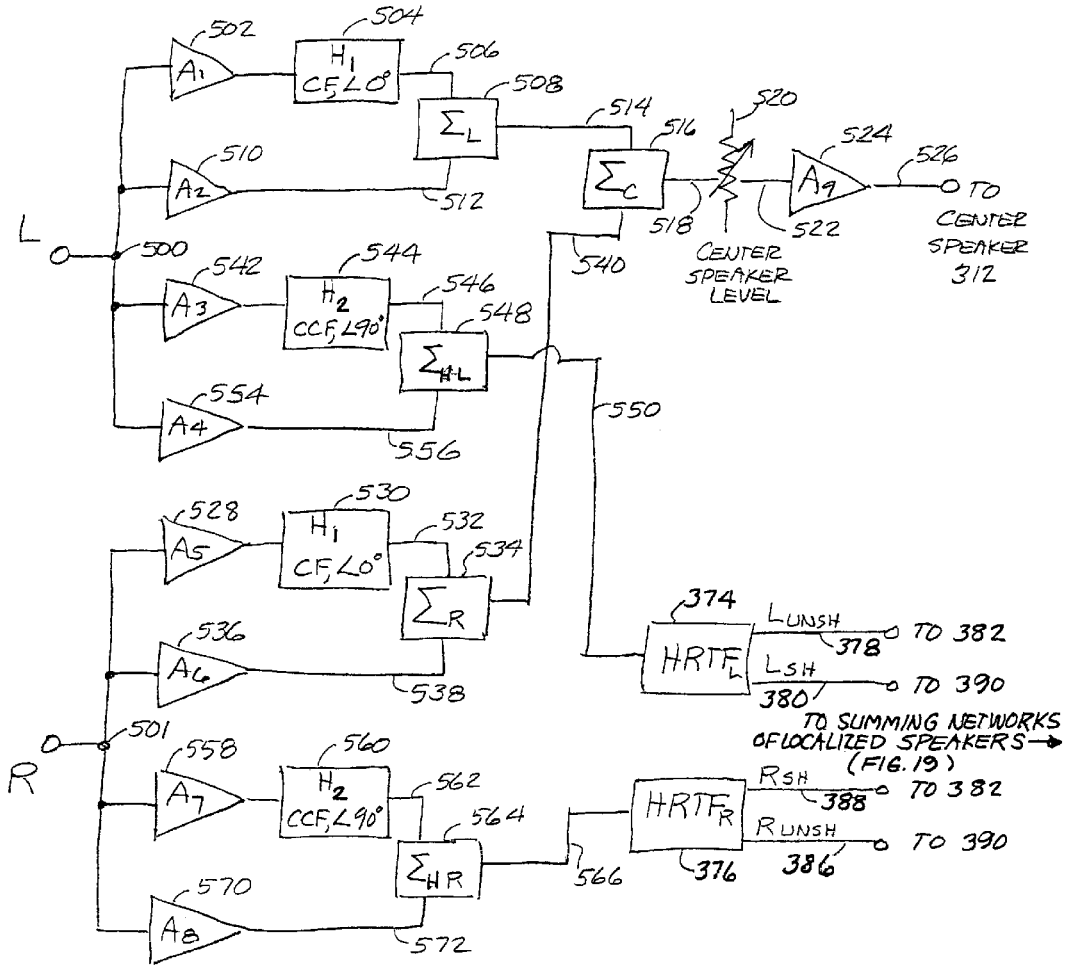
FIG. 24 illustrates a block diagram of a fifth embodiment of the processing of left and right source signals to generate a blended center channel signal according to the present disclosure.

Continuing with FIG. 23, it will be appreciated that each of the amplifiers have a particular gain designated as A with a particular suffix to identify the signal path in which the amplifier is positioned. These amplifier gains may be adjusted for specific desired effects which will become clear following the detailed description of FIG. 24. FIG. 24 illustrates a fifth embodiment that includes all of the circuitry of FIG. 23 as well as the virtual positioning system circuitry described in FIG. 19. In addition, FIG. 24 passes the signal through additional processing so that the individual channels of the signal may be controlled. Following a description of the fifth embodiment in FIG. 24, the effect of adjusting the individual gains of the amplifiers in FIG. 23 will become clear.

Referring now to FIG. 24, there is illustrated a block diagram of a fifth embodiment of the processing of left and right source signals to generate a blended center channel signal according to the present disclosure. FIG. 24 contains the identical structures described in FIG. 23, each component of the structure having the same reference number assigned thereto and thus each portion of FIG. 24 that appears in FIG. 23 will not be individually described again other than to identify the first component in each path, that being amplifiers 502, 510, 528 and 536. It will be recognized that each of these amplifiers feeds a signal in a path previously described in FIG. 23. Returning to FIG. 24 at the left channel node 500, the left signal 370 from the sound source is applied to an amplifier 542 having a gain of $A_3$ whose output is coupled to an input of a processing block 544 designated $H_2$. $H_2$ in this embodiment is a complementary comb filter having a phase shift $\Phi$ of 90°. The output of processing block 544 is coupled along path 546 to a summing block 548 designated $\Sigma_{HL}$ (summing block for the left channel headset signal) the output of which is coupled along a path 550 to an input of the $HRTF_L$ block 374. This $HRTF_L$ block 374 is identical to the $HRTF_L$ block 374 illustrated in FIG. 19 and provides the same output signals to the left and right summing blocks 382, 390 of FIG. 19 and provides the same output signals to the left and right summing blocks 382, 390 of FIG. 19. Returning to node 500, the signal present at that point is applied to the input of an amplifier 554 having a gain $A_4$ whose output is coupled along a path 556 to the summing block 548 designated $\Sigma_{HL}$.

Referring now to the right channel node 501, the right sound source signal is applied to an amplifier 558 having a gain of $A_7$ whose output is applied to an input to a processing block 560 which is a complementary comb filter having a phase shift $\Phi$ of 90° and designated $H_2$. The output of the processing block 560 is coupled along a path 562 to an input of a summing block 564 designated $\Sigma_{HR}$ for producing the blended signal for the right channel headset. The signal at node 501 is also applied to an amplifier 570 having a gain of $A_8$ whose output is provided along a path 572 to a second input of the summing block 564. The output of the summing block 564 provides a blended signal along path 566 to an input of an $HRTF_R$ block 376. This $HRTF_R$ block 376 is identical to the $HRTF_R$ block 376 shown in FIG. 19. $HRTF_L$ block 374 has a left unshadowed output 378 and a left shadowed output 380 which are coupled to respective inputs of the left channel summing block 382 to provide a blended left channel signal to the localized speakers, 358, 360. Similarly, the $HRTF_R$ block 376 has a right shadowed signal output 388 and a right unshadowed signal 386 which are coupled to respective inputs of the left and right channel summing blocks 382, 390 shown in FIG. 19 to provide the right channel components to the localized speakers 358, 360.

FIG. 24 includes nine separate amplifiers. In particular applications, the gain of each amplifier may be individually adjusted to achieve particular results. In other applications, the amplifiers may have a fixed gain and include the capability of turning ON or OFF the outputs of the respective amplifiers by a control circuit (not shown). Such control circuits are well known in the art and are not be described herein. Thus, the output of each amplifier may be designated by a 1 or 0 as a control signal to indicate whether that particular signal path is in an ON condition having an amplified signal present or is in an OFF condition in which no signal is present at the output of that particular amplifier. Thus a number of possible states of the amplifiers of FIG. 24 may be devised having different combinations of amplifiers turned ON and different combinations of amplifiers turned OFF. In this illustrative example, three different states will be described which may represent one way of defining the possible states for a system as illustrated in FIG. 24. It will be appreciated that other states are possible depending on the particular result desired by the user. Each state to be described will be defined by a particular row in TABLE I below. Each column of the table defines the possible states of a designated amplifier of FIG. 24.

TABLE I

| Amplifier: | $A_1$ | $A_2$ | $A_3$ | $A_4$ | $A_5$ | $A_6$ | $A_7$ | $A_8$ | $A_9$ |
|---|---|---|---|---|---|---|---|---|---|
| State 1 | 0 | 1 | 0 | 0 | 0 | 1 | 0 | 0 | non-zero |
| State 2 | 0 | 0 | 0 | 1 | 0 | 0 | 0 | 1 | 0 |
| State 3 | 1 | 0 | 1 | 0 | 1 | 0 | 1 | 0 | non-zero |

In TABLE I, the first state provides a center front speaker output only. In other words, it is a monaural state. The second state provides a localized headset speaker output only which is a virtual stereo state without enhancement provided by the center channel. The third state provides outputs for the localized headset speakers and the center front speakers with enhancement of the center channel. These three states are defined by ON and OFF conditions of the respective amplifiers in the embodiment of FIG. 24. Amplifier $A_9$, which drives the center speaker is ON at all times in states 1 and 3, having a non-zero gain set by the user. However, if the gain values of each amplifier can vary continuously between 0 and 1, then we can have states that vary between first and second, between second and third and of course between the first and the third states. In practice, one might prefer to only vary between the second and third states. In other situations, it might be useful to switch between first and second states or between the first and third states. For example, switching between the first and third states provides a way to compare the effect of a normal center front speaker without enhancement with the combination of the localized headset speakers and the center front speaker with enhancement of the center channel image. It might also be desired to compare the second state and the third state which would, in effect be a stereo system having the virtual positioning processing fed to the localized headset speakers with (state 3) and without (state 2) the enhanced center channel as described hereinabove. And, if one infers from the embodiment of FIG. 22, it might occur to include in the blended center channel signal a component of a low-pass-filtered, low frequency monarual signal. Thus the embodiments described in FIGS. 19 through 24, although primarily illustrative in nature to demonstrate the structural variations that are possible, suggest only a few of the possible configurations that one may devise using the components of the system as described hereinabove.

Referring now to FIGS. 25*a* and 25*b* as mentioned previously there is illustrated the approximate frequency response of the comb filters that may be employed in the processing blocks of the various embodiments described above. FIG. 25*a* illustrates the approximate response of a comb filter having a phase shift $\Phi$ of 0° as designated by the symbol $H_1$. It will be observed that this response includes a low frequency maximum at 20 Hz, a mid-frequency maximum between 200 and 2000 Hz and a third maximum near the upper end of the audio range at 20 Khz. In addition, the response curve of FIG. 25*a* includes a null in the response somewhat below 200 Hz and also in the vicinity of 5000 Hz. A response curve illustrated in FIG. 25*b* on the other hand, represents the response provided by a complementary comb filter having a phase shift $\Phi$ of 90° and designated $H_2$ in the various embodiments described hereinabove. Thus the maximums of the response curve in FIG. 25*b* correspond substantially with the nulls in the response curve of FIG. 25*b* and the null in the response curve of FIG. 25*b* occurs substantially near the mid-band maximum of the response curve illustrated in FIG. 25*a*. These response curves meet the criteria of substantially maintaining the original bandwidth in each left and right signal and of providing the respective left and right channel output signals which are substantially proportional to the respective original input channel signal levels. These criteria are necessary in order to provide a plausible pseudo-stereo image derived from a monaural signal source and a plausible virtual center channel image as applied in this illustrative example. Further details of this particular scheme for synthesizing pseudo-stereo may be obtained in the aforementioned article by Mr. Robert Orban cited previously. Here again, the use of this particular technique for synthesizing pseudo-stereo is just one example of a process for deriving blended signals for use in the center channel enhancement of a surround sound system as described in the present disclosure.

Figure 26:
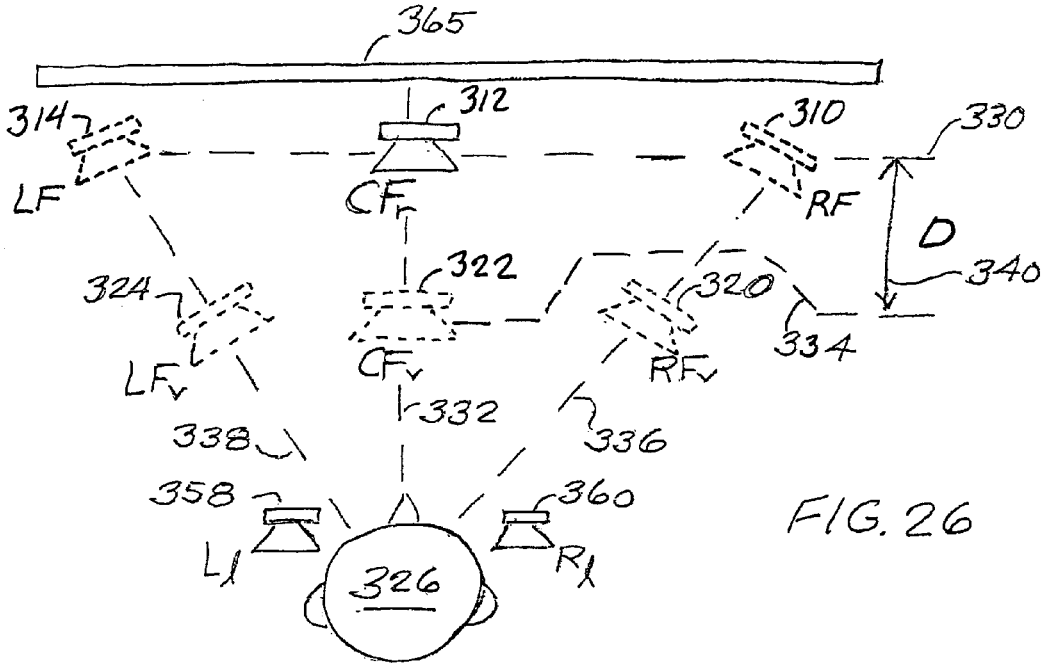
FIG. 26 illustrates a plan view of a portion of the listening environment during reproduction of a sound program having center channel enhancement and left front-right front channel enhancement according to the present disclosure.

Referring now to FIG. 26, there is illustrated a plan view of a portion of the listening environment during reproduction of the sound program having center channel enhancement and left-right front channel virtual signal processing according to the present disclosure. FIG. 26 is very similar to FIG. 18 and contains all of the same structures illustrated in FIG. 18 including the same reference numbers for the same structural elements. In addition are shown the axes of the virtual positioning of left and right channel sound sources that may be accomplished through the virtual positioning system described hereinabove to show the effect of combining the virtual positioning system with the center channel enhancement processing described according to FIGS. 19 through 25*a* and 25*b*. The portion of the listening environment shown includes a virtual right front speaker 310, a center front speaker 312 and a virtual left front speaker 314 aligned substantially in a row indicated by lateral axis 330 passing in front of a video screen 365. In practice, the actual position of the lateral axis 330 may be aligned substantially with or just behind the video screen 365 relative to the position of the listener 326. A virtual speaker position for the center front speaker is shown positioned approximately midway between the center front speaker 312 and the listener position 326 along a longitudinal axis 332. The longitudinal axis 332 passes through the listener position 326 and the center front speaker 312 to define the locus of apparent positions of a virtual image 322 to be described hereinbelow. In FIG. 18, the position of the virtual image 322 is indicated by the dashed line 324 which runs parallel to the lateral axis 330 and is separated from the lateral axis 330 by a distance D indicated by the reference number 340. As will be described hereinbelow, the distance D may vary according to the particular processing of the signals fed to the center front speaker and to a localized speaker system worn as part of the headset by the listener 326.

Continuing with FIG. 26, a right channel virtual axis 336 is shown as a dashed line connecting the position of virtual right front speaker 310 with the listener 326. Similarly, a left channel virtual axis 338 is shown as a dashed line connecting the position of the virtual left front speaker 314 with the listener position 326. Along the right channel virtual axis 336 is a virtual image of the right front speaker 320 and along the left front virtual axis 338 is positioned a virtual left front image 324. These phantom images at the virtual positions 320, 324 represent the range of apparent locations of the right front and the left front sound sources during playback of the signals processed according to the virtual positioning system as heard through the localized speaker headset represented by the localized speakers 358, 360. The center front phantom or virtual image 322 of the center front speaker 312 arises because of the processing of the left and right signals to develop a blended signal which when fed to the center front speaker 312 and to the center speaker terminal of the localized headset for localized 358, 360 provides for positioning the center front image along the center front virtual axis 332 also described as the longitudinal axis 332. The apparent distance which the center front virtual image appears forward of the lateral axis 330 is represented by the upper case letter D 340 in FIG. 26. This distance is varied by adjusting the relative amount of blended signal that appears in the center front signals fed to the center front speaker and to the localized headset. For example, in one of the previous embodiments, the center front speaker 312 receives a blended signal derived from a comb filtered network $H_1$ having a 0° phase shift and the virtual image appears due to the blended signal derived from a complementary comb filtered network $H_2$ having a phase shift $\Phi$ of 90°. By adjusting the level of the blended signal derived from the complementary comb filter $H_2$, the apparent position of the center front virtual image 322 may be moved forward and backward relative to the center front speaker 312 in order to improve the localization of the center front image and to form a more coherent overall sound image relative to the virtual sound sources represented by the left front and right front virtual sources. In a properly balanced and adjusted system the virtual images: left front, center front and right front move together to establish a virtual stereo image that is externalized away from the headset.

In summary, there has been provided a head mounted surround sound system utilizing two speakers, one disposed adjacent and slightly forward of each ear of the listener, for emulating the four front and rear speakers of a surround sound system. The speakers are initially driven by a videotape that has a surround sound system encoded thereon in two channels. The two channels are extracted from the tape and input to a surround sound system decoder which is operable to decode at least five signals therefrom, one for a left front speaker, one for a left rear speaker, one for a right front speaker, one for a right rear speaker, in addition to one for a center speaker. The four front and rear speaker signals are then processed through a virtual positioning system and combined to provide two outputs, one for the left ear speaker and one for the right ear speaker of the system.

In another embodiment the sound image may be enhanced by processing each left and right channel of a stereo signal in first and second networks to generate a blended signal. The blended signal may be fed to the center speaker and to the localized speaker system (i.e., the left ear speaker and the right ear speaker as described above) and adjusted to enhance the localization and improve the definition of the virtual positioning of the reproduced sound image.

Although the preferred embodiment has been described in detail, it should be understood that various changes, substitutions and alterations can be made therein without departing from the spirit and scope of the invention as defined by the appended claims.

What is claimed is:

1. A method for enhancing the front sound image from a listening position during reproduction in a listening space of a stereo sound program, comprising the steps of:

receiving left and right channels of the stereo sound program;

generating a virtual center channel signal from the left and right channels of the stereo sound program;

driving a physical center channel speaker with the virtual center channel signal; and producing a virtual sound source at a central location in a front portion of the listening space dispose between the physical center channel speaker and a listener position, said virtual sound source produced by a combination of physical left and right speakers disposed proximate the right and left ears of a listener a d the physical center channel speaker.

2. The method of claim 1, wherein the step of generating comprises the steps of:

processing the left and right channels of the stereo sound program in first and second networks respectively, while substantially maintaining the original overall bandwidth in each left and right channel and providing first left and right output signals each having an output level substantially corresponding to the respective original left and right channel signal levels;

blending the processed first left and right output signals to provide the virtual center channel signal; and conditioning the virtual center channel signal for driving the center channel loudspeaker.

3. The method of claim 2, wherein the step of processing further comprises the step of:

redistributing the spectral content of each left and right input channel within the audible range of frequencies.

4. The method of claim 3, wherein the step of redistributing the spectral content of each respective channel comprises the steps of:

applying the respective signal to the input of a comb filter network having a defined phase shift characteristic; and coupling each respective comb filtered output to an input of the blending network.

5. The method of claim 4, wherein the step of applying comprises the step of:

defining the phase shift characteristic for the comb filter at zero degrees.

6. The method of claim 2, wherein the step of blending comprises the step of:

summing the processed left and right channel signals.

7. The method of claim 2, wherein the step of conditioning comprises the step of:

controlling the level of the blended signal in an amplifying circuit having an adjustable gain.

8. The method of claim 1, further comprising the steps of:

processing the left and right input channels of the stereo sound program in first and second head related transfer function (HRTF) networks for each respective channel to provide second left and right output signals; and transmitting the second left and right output signals to respective left and right inputs to a localized speaker system configured as a headset for playback.

9. The method of claim 8, wherein the step of processing further comprises the step of:

redistributing the spectral content of each left and right input channel within the audible range of frequencies.

10. The method of claim 9, wherein the step of redistributing comprises the step of:

applying the respective signal to the input of a comb filter network having a defined phase shift characteristic.

11. The method of claim 10, wherein the step of applying comprises the step of:

defining the phase shift characteristic for the comb filter at ninety degrees.

12. The method of claim 8, wherein the step of processing comprises the step of:

providing each of the second left and right output signals from the first and second HRTF networks in the form of an unshadowed, nearest ear component signal and a shadowed, farthest ear component signal.

13. The method of claim 8, wherein the step of transmitting comprises the step of:

coupling the second left and right output signals via a wireless link.

14. The method of claim 8, wherein the step of transmitting comprises the step of:

coupling the second left and right output signals via a conducting link.

15. The method of claim 14, further comprising the steps of:

processing each left and right input channel of the stereo signal in first and second head related transfer function (HRTF) networks for each respective channel to provide second left and right output signals; and transmitting the second left and right output signals to respective left and right inputs to a localized speaker system configured as a headset for playback.

16. The method of claim 15, wherein the step of processing further comprises the step of:

redistributing the spectral content of each left and right input channel within the audible range of frequencies.

17. The method of claim 16, wherein the step of redistributing comprises the step of:

applying the respective signal to the input of a comb filter network having a defined phase shift characteristic.

18. The method of claim 17, wherein the step of applying comprises the step of:

defining the phase shift characteristic for the comb filter at ninety degrees.

19. The method of claim 15, wherein the step of processing comprises the step of:

providing each of the second left and right output signals from the first and second HRTF networks in the form of an unshadowed, nearest ear component signal and a shadowed, farthest ear component signal.

20. The method of claim 15, wherein the step of transmitting comprises the step of:

coupling the first end second pairs of output signals via a wireless link.

21. The method of claim 15, wherein the step of transmitting comprises the step of:

coupling the first and second pairs of output signals via a conducting link.

22. The method of claim 8, wherein the step of transmitting further comprises:

placing left and right, rearward-facing loudspeakers substantially in the plane of the zygomatic arch of a listener and proximate a respective left and right ear of the listener.

23. The method of claim 1, wherein the step of producing a virtual sound source further comprises:

listening to the stereo sound program being reproduced via front left, front center and front right loudspeakers and a localized speaker system.

24. A method for enhancing the sound field image from a listening position during reproduction of multi-channel sound, comprising the steps of:

receiving left and right channels of the stereo sound program;

generating a virtual center channel signal from the left and right channels of the stereo sound program;

driving a physical center channel speaker with the virtual center channel signal;

producing a virtual sound source at a central location in a front portion of the listening space dispose between the physical center channel speaker and the listener position;

and feeding respective left and right binauralized output signals resulting from processing the left and right channels of the stereo sound program in a binauralizer to respective left and right localized loudspeakers positioned in rearward-facing orientation in the plane of the zygomatic arch proximate each respective left and right ear of a listener, such left and right binauralized output signals from the left and right localized loudspeakers in combination with the output of the center channel speaker providing the virtual sound source.

25. The method of claim 24, wherein the step of generating comprises the steps of:

processing the left and right channels of the stereo sound program in first and second networks respectively, while substantially maintaining the original overall bandwidth in each left and right channel and providing first left and right output signals each having an output level substantially corresponding to the respective original left and right channel signal levels;

blending the processed first left and right output signals to provide the virtual center channel signal; and conditioning the virtual center channel signal for driving the center channel loudspeaker.

26. The method of claim 25, wherein the step of processing further comprises the step of:

redistributing the spectral content of each left and right input channel within the audible range of frequencies.

27. The method of claim 26, wherein the step of redistributing the spectral content of each respective channel comprises the steps of:

applying the respective signal to the input of a comb filter network having a defined phase shift characteristic; and coupling each respective comb filtered output to an input of the blending network.

28. The method of claim 27, wherein the step of applying comprises the step of:

defining the phase shift characteristic for the comb filter at zero degrees.

29. The method of claim 25, wherein the step of blending comprises the step of:

summing the processed left and right channel signals.

30. The method of claim 25, wherein the step of conditioning comprises the step of:

controlling the level of the blended signal in an amplifying circuit having an adjustable gain.

31. The method of claim 24, wherein the step of producing a virtual sound source further comprises:

listening to the stereo sound program being reproduced via front left, front center and front right loudspeakers and a localized speaker system.

* * * * *